US011022327B2

(12) United States Patent
Tadokoro et al.

(10) Patent No.: US 11,022,327 B2
(45) Date of Patent: Jun. 1, 2021

(54) OUTDOOR UNIT OF AIR-CONDITIONING APPARATUS

(71) Applicant: Mitsubishi Electric Corporation, Tokyo (JP)

(72) Inventors: Takahide Tadokoro, Tokyo (JP); Seiji Nakashima, Tokyo (JP); Shinya Higashiiue, Tokyo (JP); Naomichi Tamura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 225 days.

(21) Appl. No.: 15/570,439

(22) PCT Filed: May 14, 2015

(86) PCT No.: PCT/JP2015/063947
§ 371 (c)(1),
(2) Date: Oct. 30, 2017

(87) PCT Pub. No.: WO2016/181560
PCT Pub. Date: Nov. 17, 2016

(65) Prior Publication Data

US 2018/0156475 A1 Jun. 7, 2018

(51) Int. Cl.
*F24F 1/50* (2011.01)
*F24F 1/56* (2011.01)
(Continued)

(52) U.S. Cl.
CPC ..... *F24F 1/50* (2013.01); *F24F 1/14* (2013.01); *F24F 1/46* (2013.01); *F24F 1/56* (2013.01);
(Continued)

(58) Field of Classification Search
CPC .... F24F 13/20; F24F 13/08; F24F 1/50; F24F 1/14; F24F 1/46; F24F 1/56; F24F 2013/205
See application file for complete search history.

(56) References Cited

U.S. PATENT DOCUMENTS

2002/0134099 A1 9/2002 Mochizuki et al.
2009/0084131 A1* 4/2009 Reifel ..... F24F 1/18 62/515
(Continued)

FOREIGN PATENT DOCUMENTS

CN 1664453 A 9/2005
CN 103925742 A 7/2014
(Continued)

OTHER PUBLICATIONS

International Search Report dated Aug. 11, 2015 in PCT/JP2015/063947, filed on May 14, 2015.
(Continued)

*Primary Examiner* — Steven S Anderson, II
(74) *Attorney, Agent, or Firm* — Xsensus LLP

(57) ABSTRACT

An outdoor unit 1 of an air-conditioning apparatus includes a housing having a box shape and including air inlets formed on side surfaces and an air outlet formed on an upper surface, a fan provided to an upper side in the housing and configured to discharge, through the air outlet, outside air sucked through the air inlets, and a heat exchanger provided in the housing along each of the air inlets. The heat exchanger includes an upper heat exchanger disposed at an upper part of the housing and a lower heat exchanger disposed at a lower part of the housing. In plan view, the housing has different widths in short-side and long-side directions, and the width in the short-side direction at the
(Continued)

upper part of the housing is longer than the width in the short-side direction at the lower part of the housing.

12 Claims, 36 Drawing Sheets

(51) Int. Cl.

| | |
|---|---|
| ***F24F 13/08*** | (2006.01) |
| ***F24F 1/14*** | (2011.01) |
| ***F24F 13/20*** | (2006.01) |
| ***F24F 1/46*** | (2011.01) |

(52) U.S. Cl.
CPC ..... *F24F 13/08* (2013.01); *F24F 13/20* (2013.01); *F24F 2013/205* (2013.01)

(56) References Cited

U.S. PATENT DOCUMENTS

| | | | |
|---|---|---|---|
| 2012/0125033 | A1 | 5/2012 | Tanno et al. |
| 2013/0333409 | A1 | 12/2013 | Tanno et al. |
| 2018/0299204 | A1 | 10/2018 | Yanik et al. |

FOREIGN PATENT DOCUMENTS

| | | | | | |
|---|---|---|---|---|---|
| CN | 203980499 | U | | 12/2014 | |
| EP | 2354683 | A2 | | 8/2011 | |
| EP | 2 461 111 | A1 | | 6/2012 | |
| JP | 2001-201111 | A | | 7/2001 | |
| JP | 2003-254565 | A | | 9/2003 | |
| JP | 2003-279076 | A | | 10/2003 | |
| JP | 2005-106337 | A | | 4/2005 | |
| JP | 2006145128 | | * | 4/2006 | |
| JP | 2007-163017 | A | | 6/2007 | |
| JP | 2011-153806 | A | | 8/2011 | |
| JP | 2012-13302 | A | | 1/2012 | |
| JP | 2013079735 | A | * | 5/2013 | ..... F24F 1/56 |
| WO | WO-0151859 | A1 | * | 7/2001 | ..... F24F 1/18 |
| WO | 2004/083734 | A1 | | 9/2004 | |
| WO | WO 2011/099629 | A1 | | 8/2011 | |
| WO | WO 2014/047861 | A1 | | 4/2014 | |

OTHER PUBLICATIONS

Extended European Search Report dated Nov. 9, 2018 in Patent Application No. 15891884.7.
Combined Chinese Office Action and Search Report dated Jun. 5, 2019, in Patent Application No. 201580079693.0, 19 pages (with English translation and English Translation of Citing Documents).
Chinese Office Action issued in Chinese Patent Application No. 201580079693.0 dated Dec. 30, 2019 (w/ English Translation).
Chinese Office Action dated Jul. 15, 2020, issued in corresponding Chinese Patent Application No. 201580079693.

* cited by examiner

OUTDOOR UNIT OF AIR-CONDITIONING APPARATUS

TECHNICAL FIELD

The present invention relates to an upward-air-outlet-type outdoor unit of an air-conditioning apparatus, in which airflow generated by rotation of a fan flows through a heat exchanger.

BACKGROUND ART

In an upward-air-outlet-type outdoor unit of an air-conditioning apparatus, airflow generated by rotation of a fan flows through a heat exchanger to exchange heat between outside air and refrigerant.

To increase the capacity of the outdoor unit, it is desirable to increase the volume of the heat exchanger or increase the flow rate of air generated by the fan. However, the increase in the volume of the heat exchanger leads to increase in the installation area of the outdoor unit.

In a conventional outdoor unit of an air-conditioning apparatus, the volume of the heat exchanger is increased white the installation area of the outdoor unit is maintained (refer to Patent Literature 1, for example).

In Patent Literature 1, the heat exchanger is disposed in each of four side surfaces of an upper part of the housing in a box shape having different widths in short-side and long-side directions, thereby increasing the volume of the heat exchanger while the installation area is maintained. In addition, wind speed distribution of airflow passing through the heat exchanger is uniform without drift, thereby reducing a pressure drop in the outdoor unit and fan noise.

CITATION LIST

Patent Literature

Patent Literature 1: Japanese Unexamined Patent Application Publication No. 2003-254565

SUMMARY OF INVENTION

Technical Problem

As disclosed in Patent Literature 1, in the outdoor unit having different housing widths in the short-side and long-side directions, the distance between the heat exchanger and the fan differs between the long-side and short-side directions, which leads to nonuniform wind speed distribution of airflow passing through the heat exchanger. In particular, in the short-side direction, in which the distance between the heat exchanger and the fan is short, the wind speed through the heat exchanger is large, which leads to large passing wind resistance and increase in a pressure drop in the outdoor unit. In addition, the speed of wind sucked into the outdoor unit through air inlets on the side surfaces of the housing by the fan is not uniform and increases along the rotational direction of the fan, causing disorder in flow right before suction by the fan. This disorder leads to energy loss around vanes of the fan, and thus leads to increase in fan noise and increase in electric power consumption.

The present invention is intended to solve the problem as described above by providing an outdoor unit of an air-conditioning apparatus that can achieve noise reduction of a fan and improved heat exchange efficiency.

Solution to Problem

An outdoor unit of an air-conditioning apparatus according to an embodiment of the present invention includes a housing having a box shape and including an air inlet formed on a side surface and an air outlet formed on an upper surface, a fan provided to an upper side in the housing and configured to discharge, through the air outlet, outside air sucked through the air inlet, and a heat exchanger provided in the housing along the air inlet. The heat exchanger includes an upper heat exchanger disposed at an upper part of the housing and a lower heat exchanger disposed at a lower part of the housing. The housing has different widths in short-side and long-side directions in plan view. The width in the short-side direction at the upper part of the housing is longer than the width in the short-side direction at the upper part of the housing.

Advantageous Effects of Invention

In an outdoor unit of an air-conditioning apparatus according to an embodiment of the present invention, a width in a short-side direction is longer at an upper part of a housing than at a lower part of the housing. With this configuration, a sufficient air path can be provided in the upper part of the housing, which is close to a fan, without increasing the installation area of the outdoor unit. This configuration achieves uniform speed distribution of wind sucked into the housing through an air inlet on a side surface of the housing, thereby, achieving noise reduction of the fan and improved heat exchange efficiency.

DESCRIPTION OF EMBODIMENTS

Figure 1:
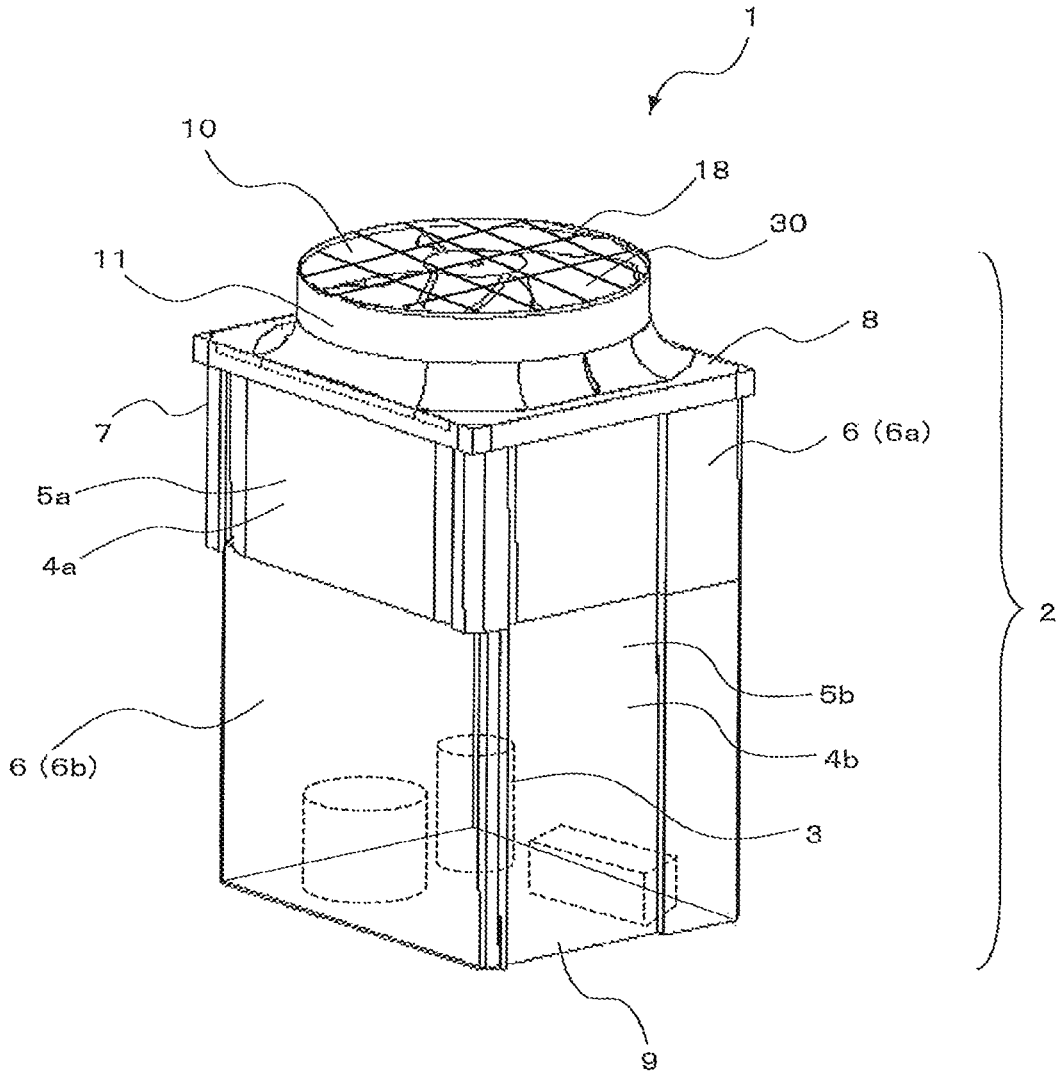
FIG. 1 is a perspective view of an outdoor unit of an air-conditioning apparatus according to Embodiment 1 of the present invention.

Embodiments of the present invention will be described below with reference to the accompanying drawings. The present invention is not limited by the embodiments described below. The sizes of components in the drawings described below have a relation different from that in reality in some cases. In the following description, upper and lower directions, right and left directions, and front and back directions are defined in front view of an outdoor unit of an air-conditioning apparatus.

Embodiment 1

Figure 2:
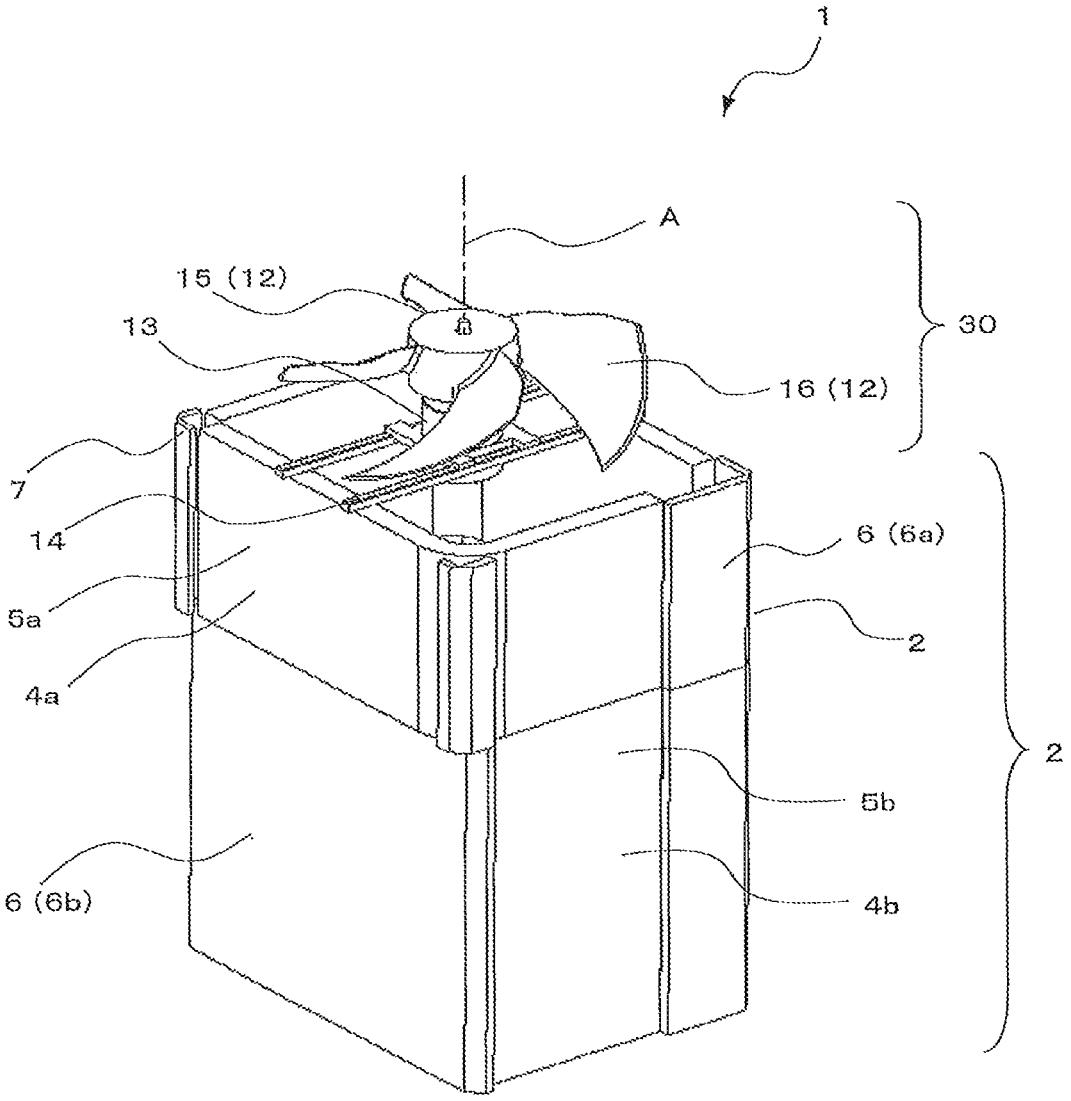
FIG. 2 is a perspective view of the outdoor unit of the air-conditioning apparatus according to Embodiment 1 of the present invention, from which an upper surface of a housing is removed.

FIG. 1 is a perspective view of an outdoor unit 1 of an air-conditioning apparatus according to Embodiment 1 of the present invention. FIG. 2 is a perspective view of the outdoor unit 1 of the air-conditioning apparatus according to Embodiment 1 of the present invention, from which an upper surface of a housing 2 is removed. In FIG. 1, some parts of components in the outdoor unit 1 are illustrated with dotted lines for description.

The air-conditioning apparatus according to the present Embodiment 1 has a refrigeration cycle in which refrigerant is circulated between an indoor unit (not illustrated) and the outdoor unit 1. The outdoor unit 1 includes the housing 2 serving as an external body, built-in devices 3 housed inside the housing 2, a heat exchanger 5, and an air-sending device 30.

The housing 2 has a box shape including an upper surface, a lower surface, and four side surfaces, and has different widths in short-side and long-side directions in plan view. The width in the short-side direction is longer at an upper part than at a lower part.

An air inlet 4*a* is formed on each of the four side surfaces of the upper part of the housing 2, and an air inlet 4*b* is formed on one of the four side surfaces of the lower part of the housing 2.

The heat exchanger 5 is configured to exchange heat between the refrigerant and air, and includes an upper heat exchanger 5*a* and a lower heat exchanger 5*b* that are independent from each other. The upper heat exchanger 5*a* s provided in the housing 2 along the air inlet 4*a* formed on each side surface of the upper part of the housing 2, and the lower heat exchanger 5*b* is provided in the housing 2 along the air inlet 4*b* formed on the side surface of the lower part of the housing 2.

An upper side-surface panel 6*a* is provided on the side surfaces of the upper part of the housing 2 at an area on which the air inlet 4*b* is not formed, and a lower side-surface panel 6*b* is provided on the side surfaces of the lower part of the housing 2 at an area on which the air inlet 4*a* is not formed. A side-surface panel 6 (collectively referring to the upper side-surface panel 6*a* and the lower side-surface panel 6*b*) is a wind shielding member preventing airflow into the outdoor unit 1.

An L-shaped (or chamfered in an L shape) support 7 is provided at each corner of the housing 2 to maintain the structure of the housing 2. The side-surface panel 6 is fixed to the support 7 by screwing or fitting The side-surface panel 6 corresponds to a "wind shielding plate" according to the present invention.

A top plate 8 and a bell mouth 11 are provided on the upper surface of the housing 2. The top plate 8 covers an upper end of the upper heat exchanger 5*a* and an air outlet 10 is formed on the top plate 8. The bell mouth 11 is provided on an upper surface of the top plate 8, surrounding the air outlet 10, and includes an opening port communicated with the air outlet 10. A circular guard 18 formed of bars disposed in a lattice shape is provided at the opening port of the bell mouth 11 to block the opening port of the bell mouth 11.

A bottom plate 9 on which (part of) the built-in devices 3 and the lower heat exchanger 5*b* are placed is provided on the lower surface of the housing 2.

The built-in devices 3 include refrigeration cycle devices, such as a compressor, a solenoid valve, and a heat transfer pipe (refrigerant pipe), included in the refrigeration cycle, and a drive control device configured to drive and control the refrigeration cycle devices and the air-sending device 30.

As illustrated in FIG. 2, the air-sending device 30 includes a fan 12 configured to rotate about an axis line A along a height direction of the outdoor unit 1, and a fan motor (drive unit) 13 configured to rotate the fan 12 coupled with the fan motor 13. The fan motor 13 is supported by a motor support 14. The air-sending device 30 is disposed in the housing 2 at a position shifted upward relative to the built-in devices 3 in the direction of the axis line A. In other words, the air-sending device 30 (fan 12) is provided on an upper side of the housing 2 (rather than a lower side)

The fan 12 is a propeller fan including a boss 15 disposed on the axis line A and a plurality (in this example, four) of vanes 16 provided to an outer periphery of the boss 15. The fan 12 is provided facing to the air outlet 10. The vanes 16 are separated from each other in a circumferential direction of the boss 15. The fan motor 13 is disposed below the fan 12.

Figure 3:
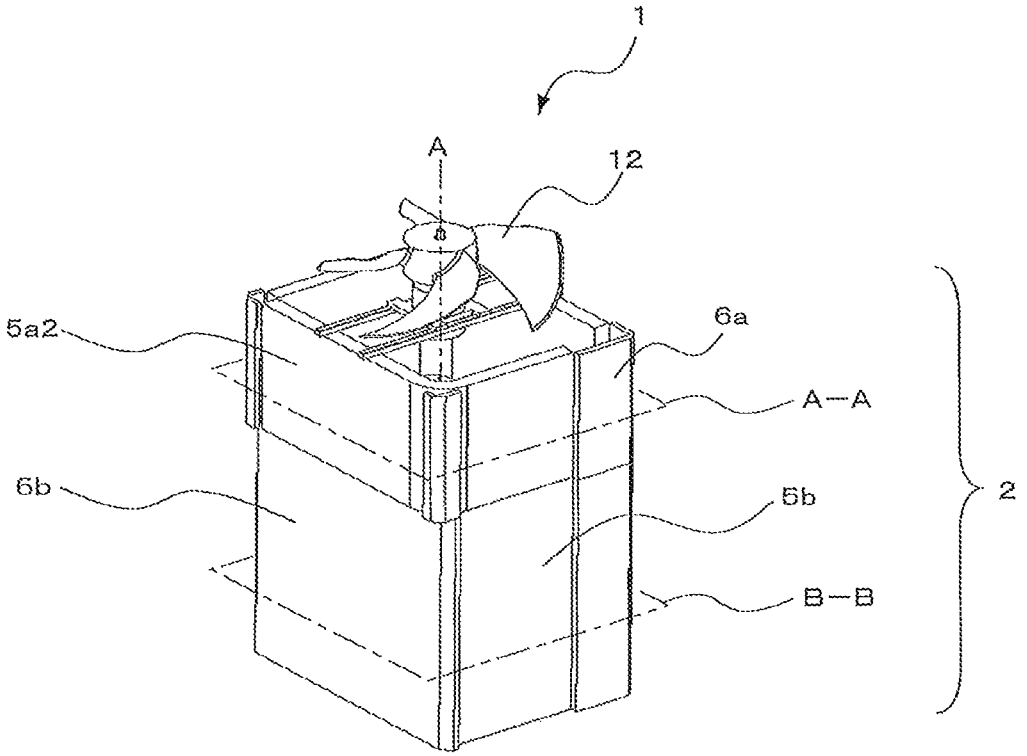
FIG. 3 is a diagram for description of cross sections of the outdoor unit of the air-conditioning apparatus according to Embodiment 1 of the present invention.
Figure 3A:
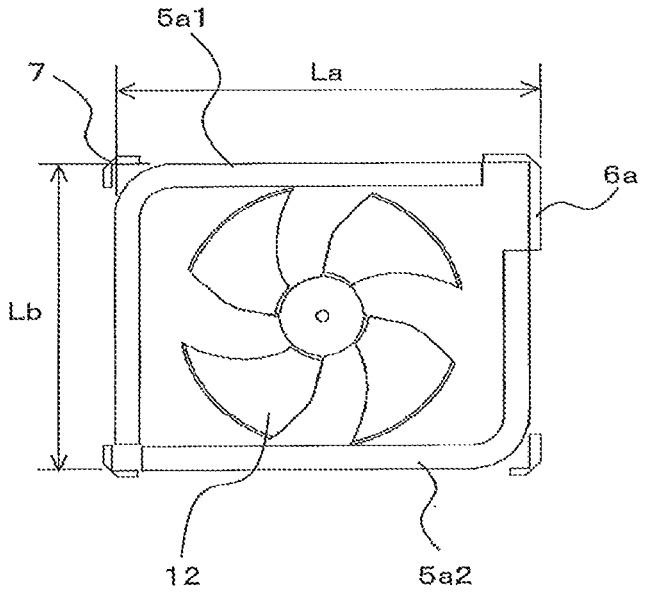
FIG. 3*a* is a schematic diagram of section A-A in FIG. 3.
Figure 3B:
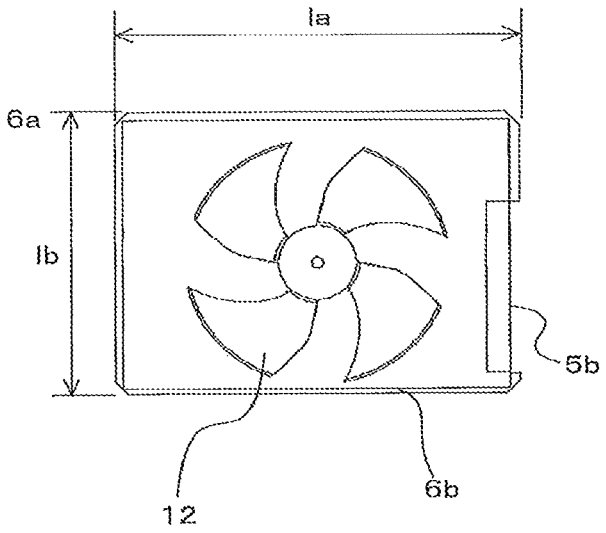
FIG. 3*b* is a schematic diagram of section B-B in FIG. 3.

FIG. 3 is a diagram for description of cross sections of the outdoor unit 1 of the air-conditioning apparatus according to Embodiment 1 of the present invention. FIG. 3*a* is a schematic diagram of section A-A in FIG. 3. FIG. 3*b* is a schematic diagram of section B-B in FIG. 3.

FIGS. 3*a* and 3*b* are each a schematic diagram of a cross section of the housing 2 taken along a direction orthogonal to the direction of the axis line A of the fan 12. FIG. 3*a* is a section schematic diagram of the upper part of the housing 2. FIG. 3*b* is a section schematic diagram of the lower part of the housing 2. FIGS. 3*a* and 3*b* each illustrate the fan 12 to indicate a positional relation between the fan 12 and the heat exchanger 5.

As illustrated in FIG. 3*a*, the upper heat exchanger 5*a*, the upper side-surface panel 6*a* substantially L-shaped in plan view, and the supports 7 each substantially L-shaped in plan view serve as the side surfaces of the upper part of the housing 2. The upper heat exchanger 5*a* includes two upper heat exchangers 5*a*1 and 5*a*2 each substantially L-shaped in plan view and disposed to serve as the four side surfaces of the upper part of the housing 2.

The upper heat exchanger 5*a*1 corresponds to a "first upper heat exchanger" according to the present invention, and the upper heat exchanger 5*a*2 corresponds to a "second upper heat exchanger" according to the present invention.

As illustrated in FIG. 3*b*, the lower heat exchanger 5*b* and the lower side-surface panel 6*b* substantially C-shaped in plan view serve as the side surfaces of the lower part of the housing 2. The lower heat exchanger 5*b* has a flat plate shape and is disposed to serve as one side surface in the long-side direction among the four side surfaces of the lower part of the housing 2.

Housing widths at the upper and lower parts of the housing 2 of the outdoor unit 1 according to the present Embodiment 1 are related to an internal air path of the outdoor unit 1 as described later, and thus are defined by any component serving as the air path. Specifically, the housing widths are defined by the lengths of outer surfaces of the upper heat exchanger 5*a*, the lower heat exchanger 5*b*, the upper side-surface panel 6*a*, and the lower side-surface panel 6*b* serving as the side surfaces of the housing 2, or by the distance between the outer surfaces of the side surfaces facing to each other, but are not define d by each distance between the supports 7 at the corners of the housing 2.

As illustrated in FIG. 3*a*, a horizontal width La and a vertical width Lb have different lengths in the section at the upper part of the housing 2. The horizontal width La is the housing width of the upper part of the housing 2 in the long-side direction, and the vertical width Lb is the housing width of the upper part of the housing 2 in the short-side direction.

The horizontal width La in the section at the upper part of the housing 2 is defined by the distance between the outer surfaces of the upper heat exchanger 5*a*1 and the upper side-surface panel 6*a* facing to the upper heat exchanger 5*a*1. The vertical width Lb is defined by the distance between the outer surfaces of the upper heat exchangers 5*a*1 and 5*a*2.

As illustrated in FIG. 3*b*, a horizontal width la and a vertical width lb have different lengths in the section at the lower part of the housing 2. The horizontal width la is the housing width of the lower part of the housing 2 in the long-side direction, and the vertical width lb is the housing width of the lower part of the housing 2 in the short-side direction.

The horizontal width la in the section at the lower part of the housing 2 is defined by the length of the outer surface of the lower side-surface panel 6*b* disposed perpendicular to the lower heat exchanger 5*b*. The vertical width lb is defined by the length of the outer surface of the lower side-surface panel 6*b*, facing to the lower heat exchanger 5*b*, in the short-side direction.

Figure 4:
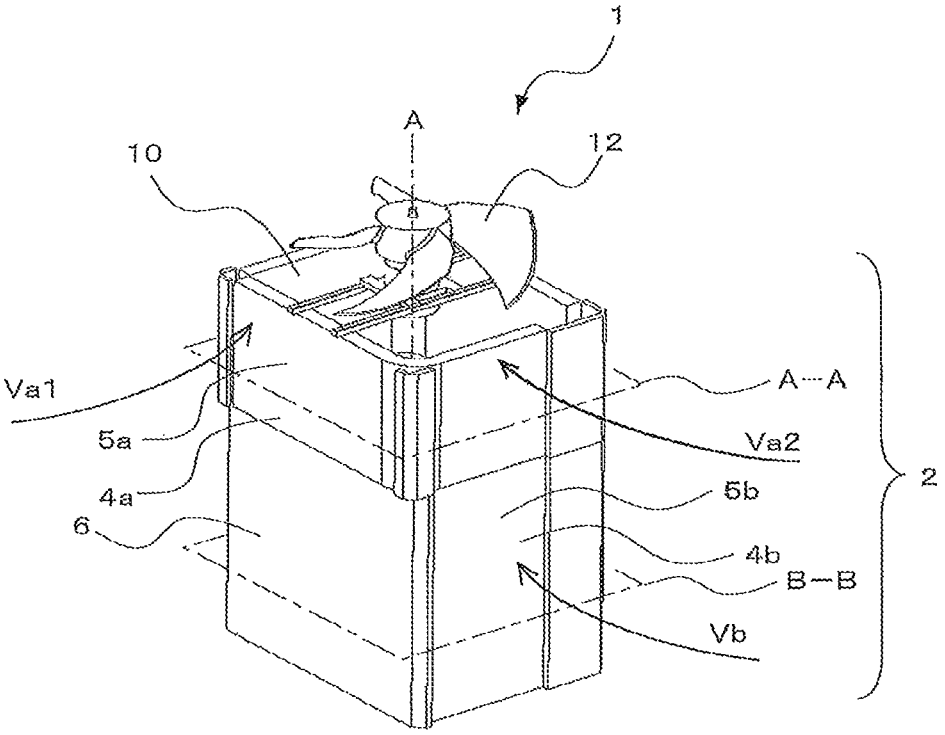
FIG. 4 is a diagram for description of operation of the outdoor unit of the air-conditioning apparatus according to Embodiment 1 of the present invention.
Figure 4A:
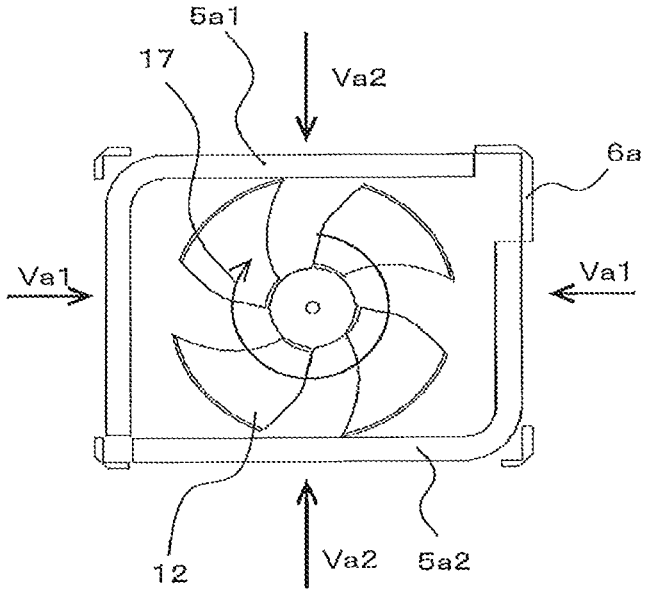
FIG. 4*a* is a schematic diagram of section A-A in FIG. 4.
Figure 4B:
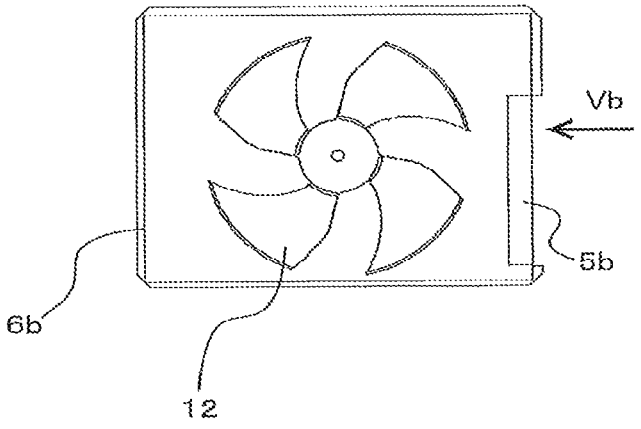
FIG. 4*b* is a schematic diagram of section B-B in FIG. 4.

FIG. 4 is a diagram for description of operation of the outdoor unit 1 of the air-conditioning apparatus according to Embodiment 1 of the present invention. FIG. 4*a* is a schematic diagram of section A-A in FIG. 4. FIG. 4*b* is a schematic diagram of section B-B in FIG. 4.

The following describes the operation of the outdoor unit 1 of the air-conditioning apparatus according to the present Embodiment 1.

The outdoor unit 1 according to the present Embodiment 1 is an upward-air-outlet type in which winds (airflows) Va1, Va2, and Vb generated by rotation of the fan 12 flow to the inside of the housing 2 through the air inlets 4*a* and 4*b* on the side surfaces of the housing 2 as illustrated in FIG. 4, and then flows from the inside of the housing 2 to the outside of the housing 2 through the air outlet 10. The wind Va1 passes through the upper heat exchanger 5*a* across the short-side direction, the wind Va2 passes through the upper heat exchanger 5*a* across the long-side direction, and the wind Vb passes through the lower heat exchanger 5*b*.

The winds (airflows) each correspond to "outside air" according to the present invention.

While passing through a part at which the heat exchanger 5 is disposed, the winds flowing to the inside of the housing 2 exchanges heat with the refrigerant passing through a heat transfer pipe (not illustrated) of the heat exchanger 5. The winds are prevented from flowing to the inside of the housing 2 through the side surfaces of the housing 2 where the side-surface panel 6 is disposed.

The winds Va1 and Va2 passing through the upper heat exchanger 5*a*, which is closer to the fan 12, flow to the inside of the housing 2 through a wider range in a rotational direction 17 of the fan 12 than the wind Vb passing through the lower heat exchanger 5*b* which is farther from the fan 12.

With this configuration, the nonuniformity of speed distribution (hereinafter referred to as suction wind speed distribution) of wind sucked to the inside of the housing 2 through the air inlets 4*a* and 4*b* on the side surfaces of the housing 2 is smaller in the rotational direction of the fan 12 in an upstream region in which the upper heat exchanger 5*a* is disposed closer to the fan 12 than in a downstream region in which the lower heat exchanger 5*b* is disposed farther from the fan 12.

Figure 5:
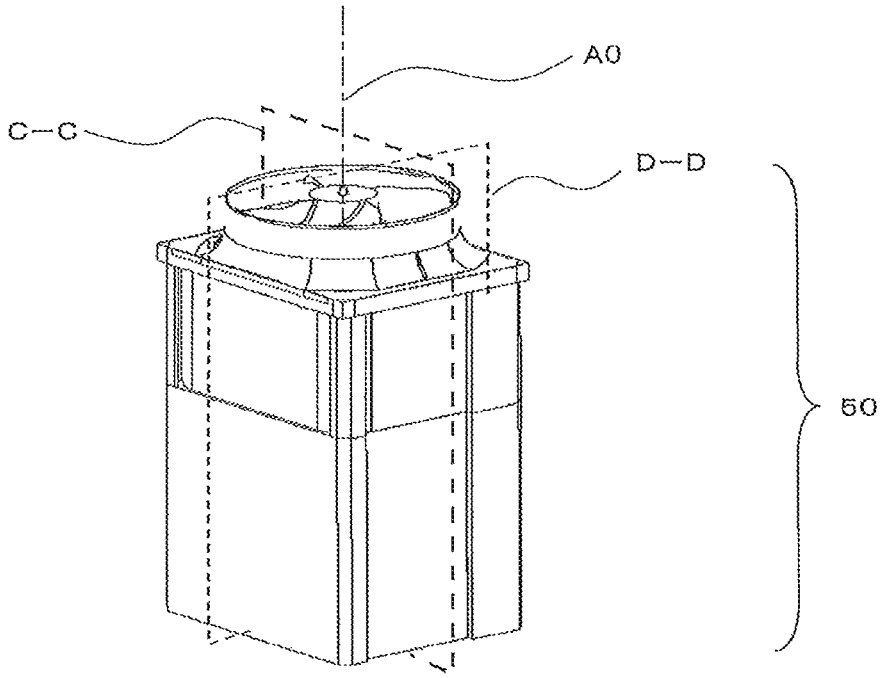
FIG. 5 is a diagram for description of longitudinal sections of a conventional outdoor unit of an air-conditioning apparatus.
Figure 5A:
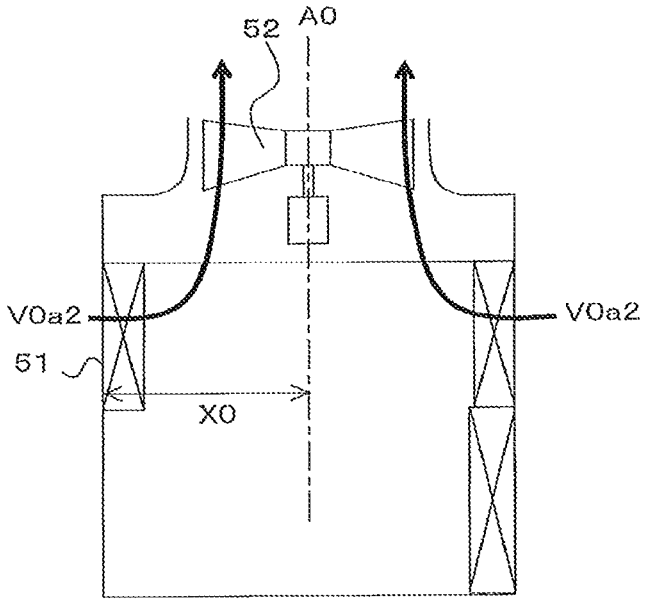
FIG. 5*a* is a schematic diagram of section C-C in FIG. 5.
Figure 5B:
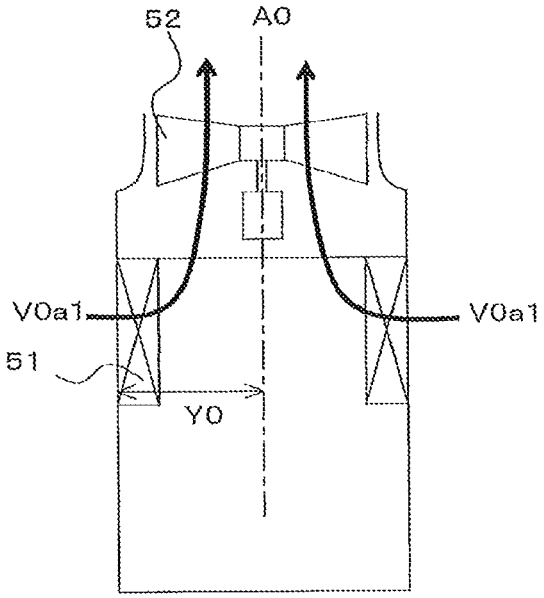
FIG. 5*b* is a schematic diagram of section D-D in FIG. 5.

FIG. 5 is a diagram for description of longitudinal sections of a conventional outdoor unit of an air-conditioning apparatus. FIG. 5*a* is a schematic diagram of section C-C in FIG. 5. FIG. 5*b* is a schematic diagram of section D-D in FIG. 5.

FIGS. 5*a* and 5*b* are each a schematic diagram of a longitudinal section of a housing 50 taken along the direction of an axis line A0 of a fan 52. FIG. 5*a* is a schematic diagram of a section in the long-side direction including the axis line A0 of the fan 52. FIG. 5*b* is a schematic diagram of a section in the short-side direction including the axis line A of the fan 52.

In the conventional output unit, the distance X0 between the axis line A0 of the fan 52 and an outer surface of an upper heat exchanger 51 in the long-side direction illustrated in FIG. 5*a* is longer than the distance Y0 between the axis line A0 of the fan 52 and an outer surface of the upper heat exchanger 51 in the short-side direction illustrated in FIG. 5*b*. In other words, the distance between vanes of the fan 52 and the upper heat exchanger 51 is shorter in the short-side direction than in the long-side direction. Consequently, as illustrated in FIGS. 5*a* and 5*b*, a wind V0*a*1 in the short-side direction passes through the upper heat exchanger 51 faster than a wind V0*a*2 in the long-side direction, and thus the wind speed through the upper heat exchanger 51 is not uniform.

As the distance between the vanes of the fan 52 and the upper heat exchanger 51 is shorter in the short-side direction than in the long-side direction, the wind V0*a*1 passing through the upper heat exchanger 51 in the short-side direction flows further on the inner side of the vanes of the fan 52 than the wind V0*a*2 passing through the upper heat exchanger 51 in the long-side direction. Moment is smaller and the efficiency of the vanes is lower on the inner side of the fan 52, and thus the wind V0*a*1 sucked in the short-side direction has an air-sending efficiency lower than that of the wind V0*a*2 sucked in the long-side direction.

Figure 6:
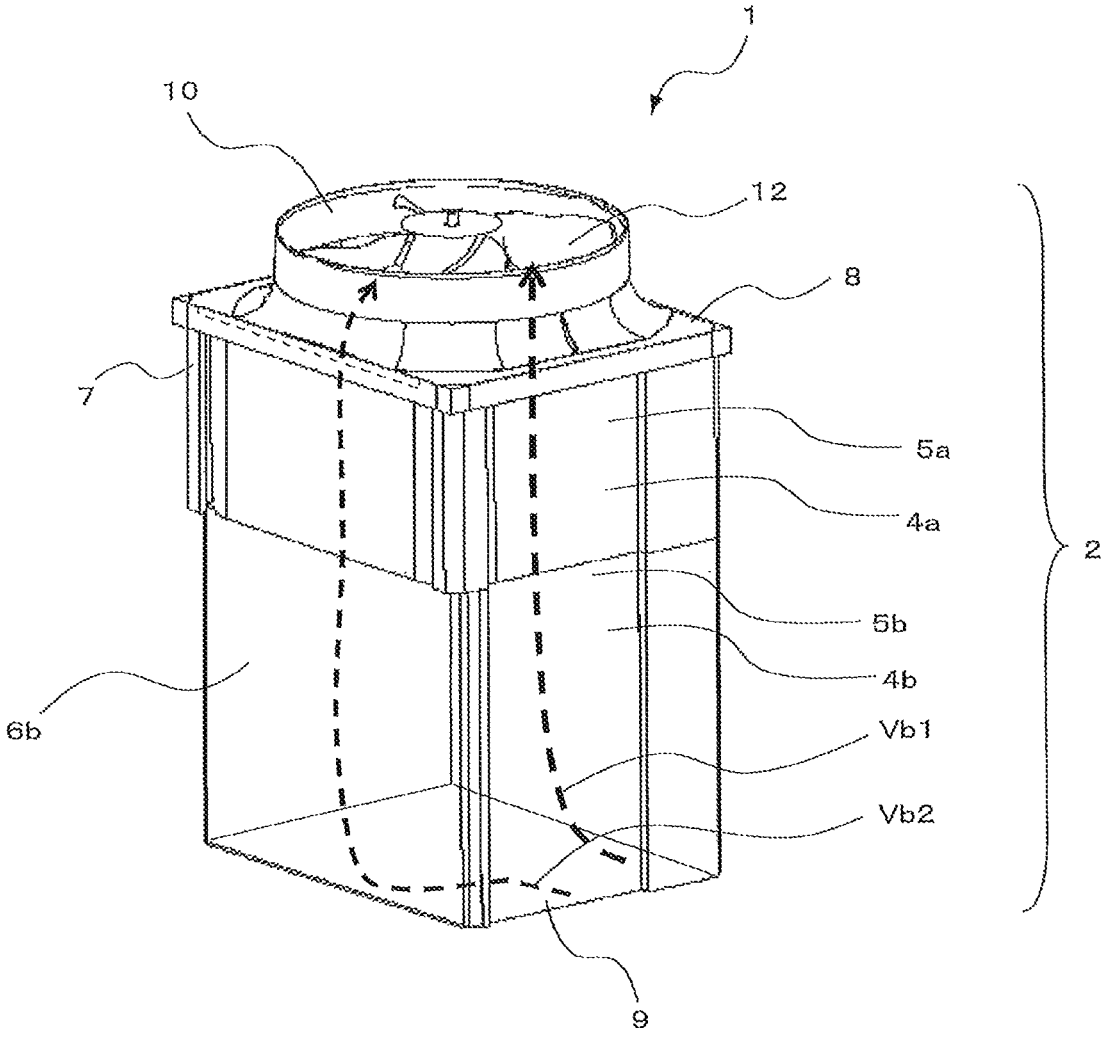
FIG. 6 is a schematic diagram illustrating flow of wind inside the outdoor unit of the air-conditioning apparatus according to Embodiment 1 of the present invention.

FIG. 6 is a schematic diagram illustrating flow of wind inside the outdoor unit 1 of the air-conditioning apparatus according to Embodiment 1 of the present invention.

As illustrated in FIG. 6, a wind Vb1 as a part of the wind Vb having flowed in through the air inlet 4*b* and passed through the lower heat exchanger 5*b* flows toward the air outlet 10 above, whereas a wind Vb2 as a part of the wind Vb flows on the bottom plate 9 as a lower surface of the outdoor unit 1 and then flows toward the air outlet 10 above along the lower side-surface panel 6*b* adjacent or facing to the lower heat exchanger 5*b*.

Figure 7:
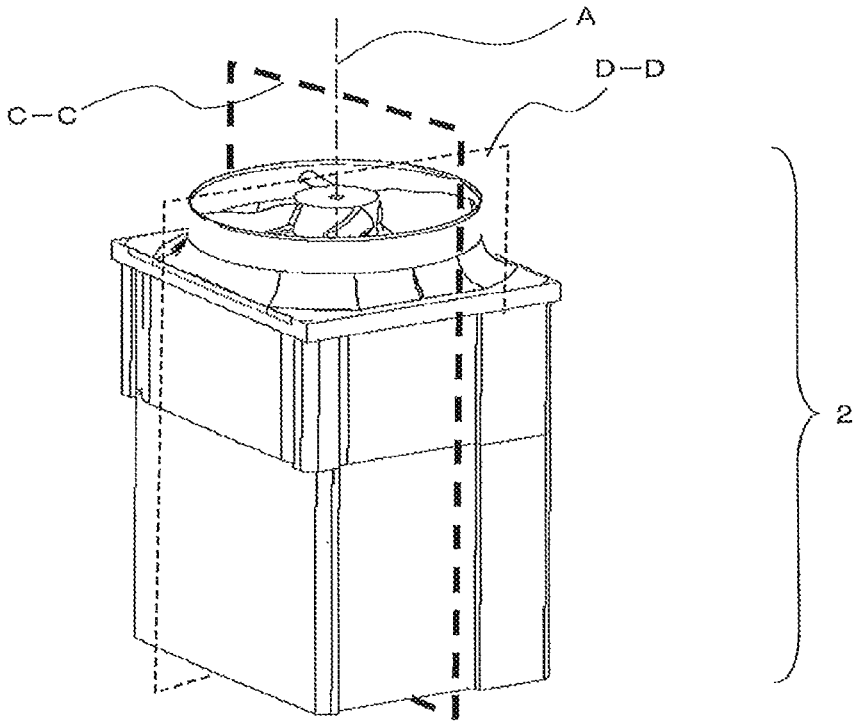
FIG. 7 is a diagram for description of longitudinal sections of the outdoor unit of the air-conditioning apparatus according to Embodiment 1 of the present invention.
Figure 7A:
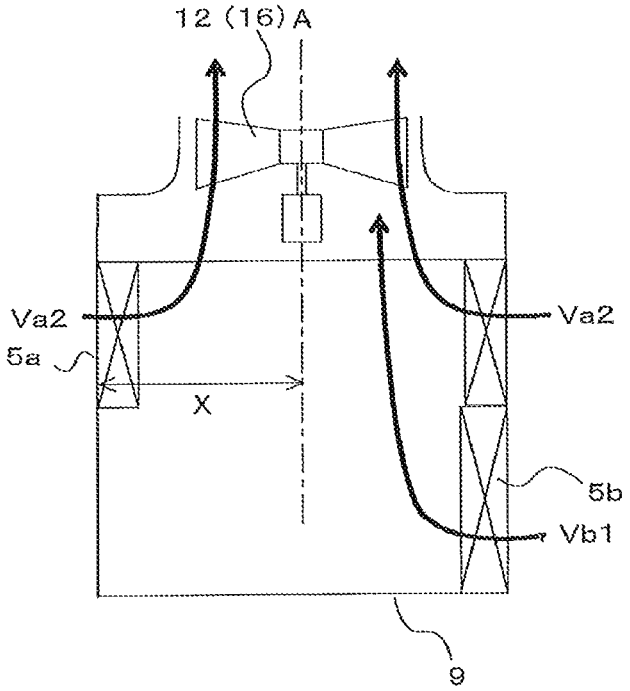
FIG. 7*a* is a schematic diagram of section C-C in FIG. 7.
Figure 7B:
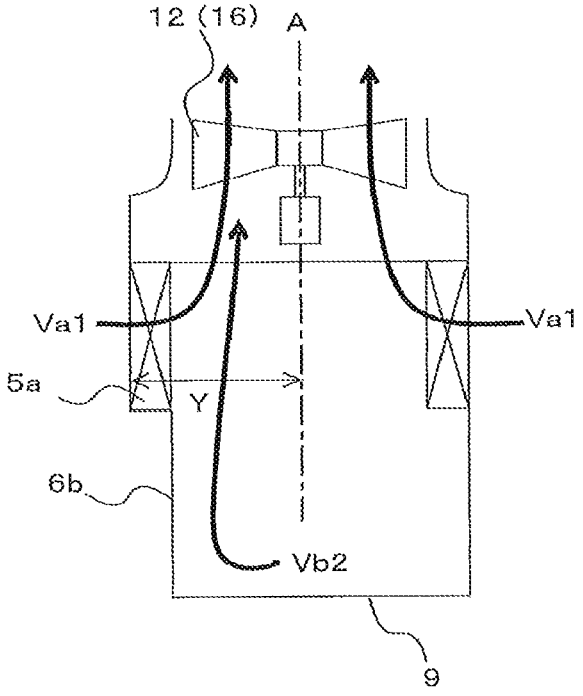
FIG. 7*b* is a schematic diagram of section D-D in FIG. 7.

FIG. 7 is a diagram for description of longitudinal sections of the outdoor unit 1 of the air-conditioning apparatus according to Embodiment 1 of the present invention. FIG. 7*a* is a schematic diagram of section C-C in FIG. 7. FIG. 7*b* is a schematic diagram of section D-D in FIG. 7.

FIGS. 7*a* and 7*b* are each a schematic diagram of a longitudinal section of the housing 2 taken along the direction of the axis line A of the fan 12. FIG. 7*a* is a schematic diagram of a section in the long-side direction including the axis line A of the fan 12. FIG. 7*b* is a schematic diagram of a section in the short-side direction including the axis line A of the fan 12.

In the present Embodiment 1, the distance X between the outer surface of the upper heat exchanger 5*a* in the long-side direction illustrated in FIG. 7*a* and the axis line A of the fan is longer than the distance Y between the outer surface of the upper heat exchanger 5*a* in the short-side direction illustrated in FIG. 7*b* and the axis line A of the fan, and the distance Y is longer than the distance Y0. In this manner, the distance Y in the short-side direction is closer to the distance X in the long-side direction, and thus the wind speed through the heat exchanger 5 can be more uniform between the short-side direction and the long-side direction as compared to conventional cases. The distance X is equal to the distance X0.

As illustrated in FIGS. 3*a* and 3*b*, the vertical width Lb of the upper part of the housing 2, at which the upper heat exchangers 5*a* disposed closer to the fan 12 serve as the four side surfaces, is longer than the vertical width lb of the lower part of the housing 2, at which the lower heat exchanger 5*b* disposed farther from the fan 12 serves as one side surface.

In other words, in the outdoor unit 1 of the air-conditioning apparatus according to the present Embodiment 1, the horizontal widths La and la are longer than the vertical widths Lb and lb, and the vertical width Lb is longer than the vertical width lb. The horizontal width La is equal to the horizontal width la.

This configuration leads to increase in a space around the fan 12 (the air path at the upper part of the housing 2), and allows the distance between the axis line A of the fan 12 and each upper heat exchanger 5*a* to be more uniform between the short-side direction and the long-side direction, thereby achieving more uniform suction wind speed distribution in the rotational direction of the fan 12.

In conventional cases, as the distance between the vanes of the fan 52 and the upper heat exchanger 51 is shorter in the short-side direction than in the long-side direction (that is, Y0<X0) as illustrated in FIG. 5*b*, the wind V0*a*1 having passed through the upper heat exchanger 51 in the short-side direction nonuniformly flows further on the inner side of the vanes of the fan 52 than the wind V0*a*2 having passed through the upper heat exchanger 51 in the long-side direction. In the present Embodiment 1, however, as the distance Y between the axis line A of the fan 12 and the upper heat exchanger 5*a* in the short-side direction is longer than the distance Y0 as illustrated in FIG. 7*b*, the wind Va1 having passed through the upper heat exchanger 5*a* in the short-side direction is likely to be sucked on the outer side of the vanes 16 of the fan 12 as compared to conventional cases.

As illustrated in FIGS. 7*a* and 7*b*, as the wind Vb2 as a part of the wind Vb1 having passed through the lower heat exchanger 5*b* flows on the bottom plate 9 as the lower surface of the outdoor unit 1 and then flows upward along the lower side-surface panel 6*b*, the wind Vb2 flows on the inner side of the vanes 16 of the fan 12 where the outer surface of the lower side-surface panel 6*b* is disposed in the inner side of the outer surface of the upper heat exchanger 5*a*, thereby achieving more uniform wind speed distribution in a radial direction of the fan 12.

These effects collectively achieve the outdoor unit 1 of the air-conditioning apparatus, which can achieve noise reduction of the fan 12 and improved heat exchange efficiency. As an example of the effects of the present Embodiment 1, when the short-side direction is increased by 105% to 110% relative to the diameter of the fan 12 in a 10-horsepower outdoor unit for a building, the fan 12 achieves improvements such as reduction of 8% in electric power consumption and reduction of 1.5 dB in noise.

As described above, in the present Embodiment 1, the vertical width Lb of the upper part of the housing 2, which is closer to the fan 12, is longer than the vertical width lb of the lower part of the housing 2, which is farther from the fan 12. This configuration ensures the space around the fan 12 (the air path at the upper part of the housing 2) without increasing an installation area of the outdoor unit 1, when the width of the bottom plate 9 in the short-side direction is set to be the vertical width of the housing 2, thereby achieving noise reduction of the fan 12 and improved heat exchange efficiency. In addition, the vertical width of the upper part of the housing 2, which is increased as compared to conventional cases, can be used to increase the diameter of the fan 12, thereby achieving an increased air volume of the outdoor unit 1.

Figure 8A:
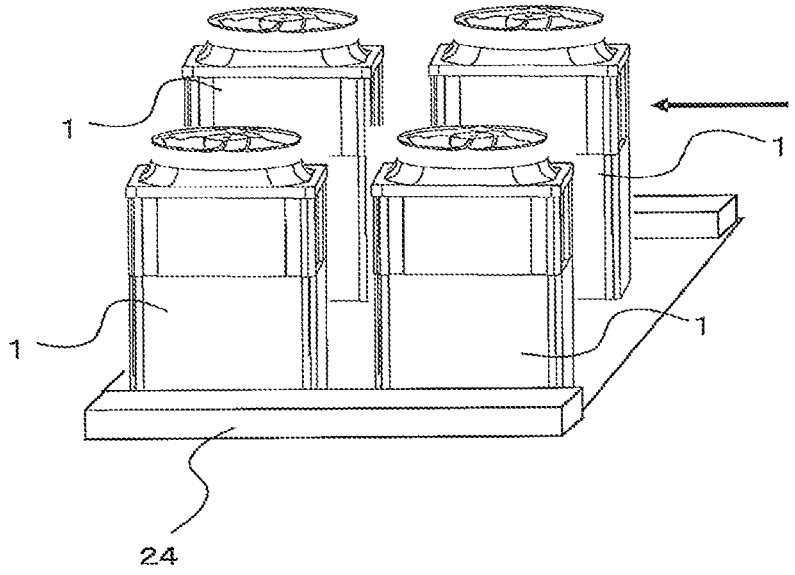
FIG. 8*a* is a perspective view illustrating exemplary installation of the outdoor units of the air-conditioning apparatus according to Embodiment 1 of the present invention.
Figure 8B:
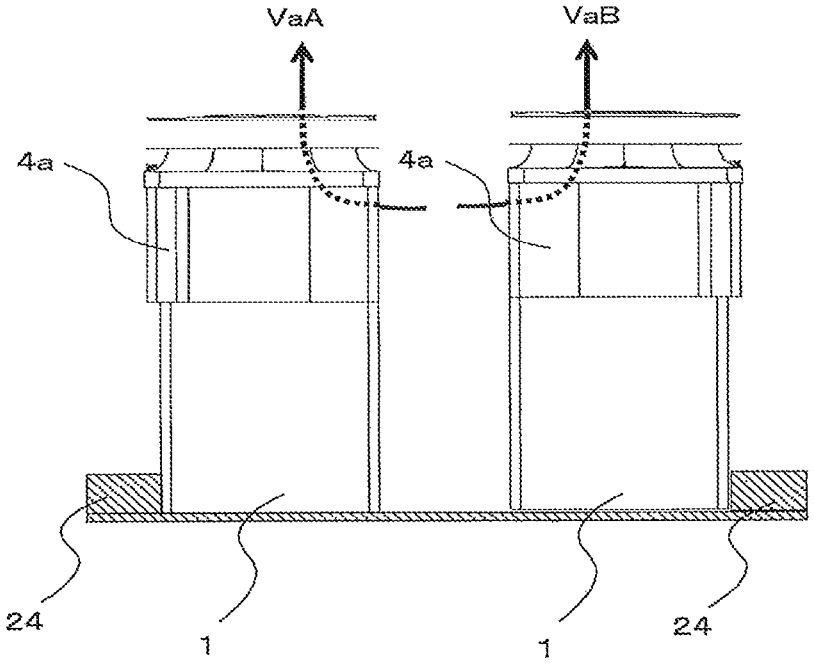
FIG. 8*b* is a front view illustrating exemplary installation of the outdoor units of the air-conditioning apparatus according to Embodiment 1 of the present invention.

FIG. 8*a* is a perspective view illustrating, exemplary installation of the outdoor units 1 of the air-conditioning apparatus according to Embodiment 1 of the present invention. FIG. 8*b* is a front view illustrating the exemplary installation of the outdoor units 1 of the air-conditioning apparatus according to Embodiment 1 of the present invention.

Next follows a description of advantages of installing the outdoor unit 1.

The outdoor unit 1 of the air-conditioning apparatus according to the present Embodiment 1 is often used to achieve huge capacity and placed on the building roof of a building or a shop. The following describes an example in which the outdoor units 1 are disposed on a roof on which joists 24 protruding upward are installed as illustrated in FIG. 8*a*. When the outdoor unit 1 according to the present Embodiment 1 is installed such that the short-side direction is perpendicular to the long-side direction of the joist 24 in plan view, the upper heat exchanger 5*a* protrudes in a space above the joist 24 as illustrated in FIG. 8*b*. This configuration allows the space above the joist 24, which has not been conventionally used, to be utilized as a part of the installation area the outdoor unit 1, and thus allows a space on the roof to be utilized effectively.

When installed between the partitioning joists 24 as illustrated in FIG. 8*b*, the two outdoor units 1 can face to each other at a larger interval to avoid division of wind to be sucked through the air inlets 4*a* of the two outdoor units 1, which leads to reduction in the electric power consumption of each fan 12.

Embodiment 2

The following describes Embodiment 2 of the present invention. Any duplicate description of Embodiment 1 will be (partially) omitted, and any part identical to or equivalent to that in Embodiment 1 is denoted by an identical reference sign.

Figure 9:
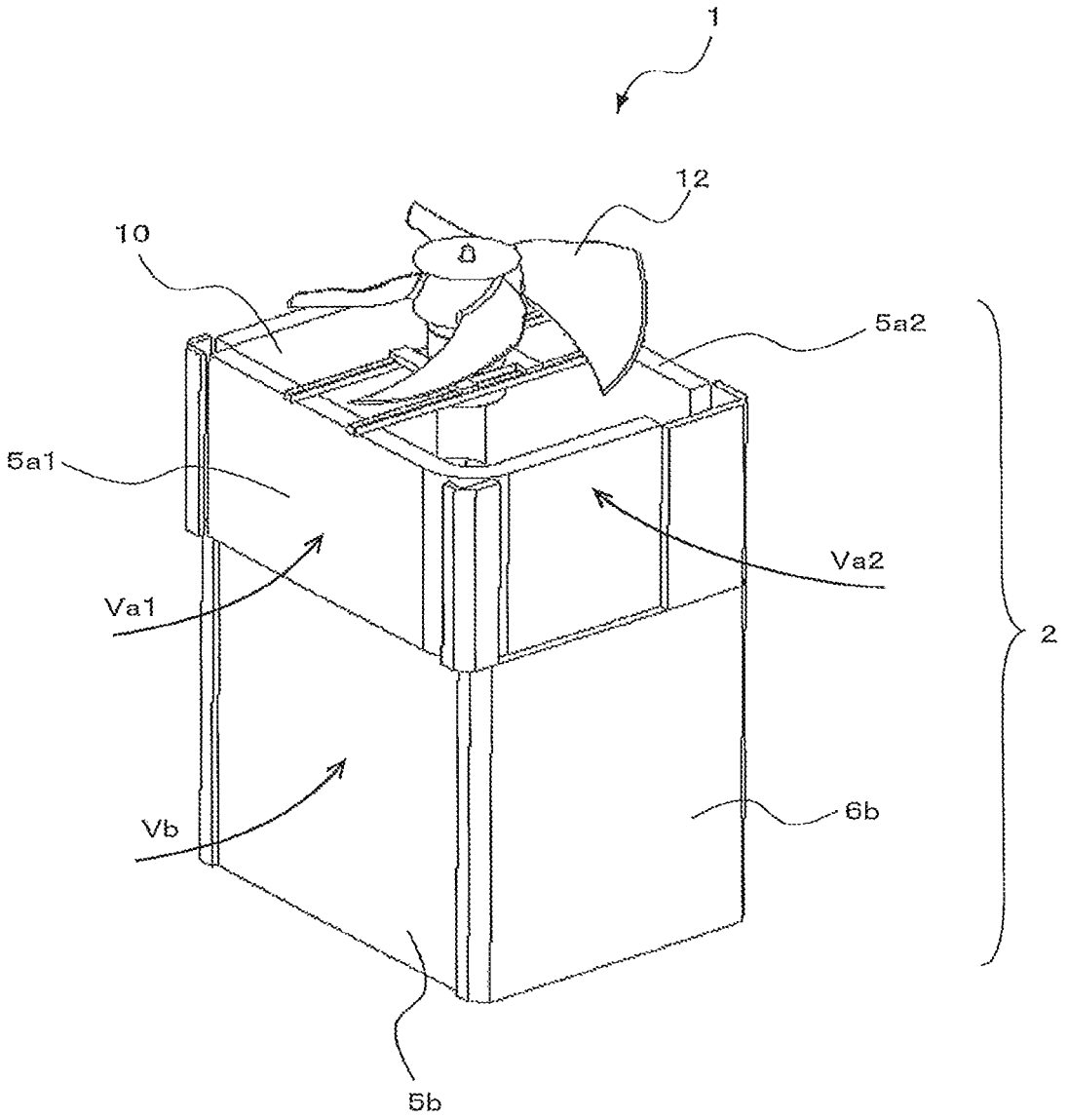
FIG. 9 is a perspective view of the outdoor unit of the air-conditioning apparatus according to Embodiment 2 of the present invention, from which the upper surface of the housing is removed.
Figure 10:
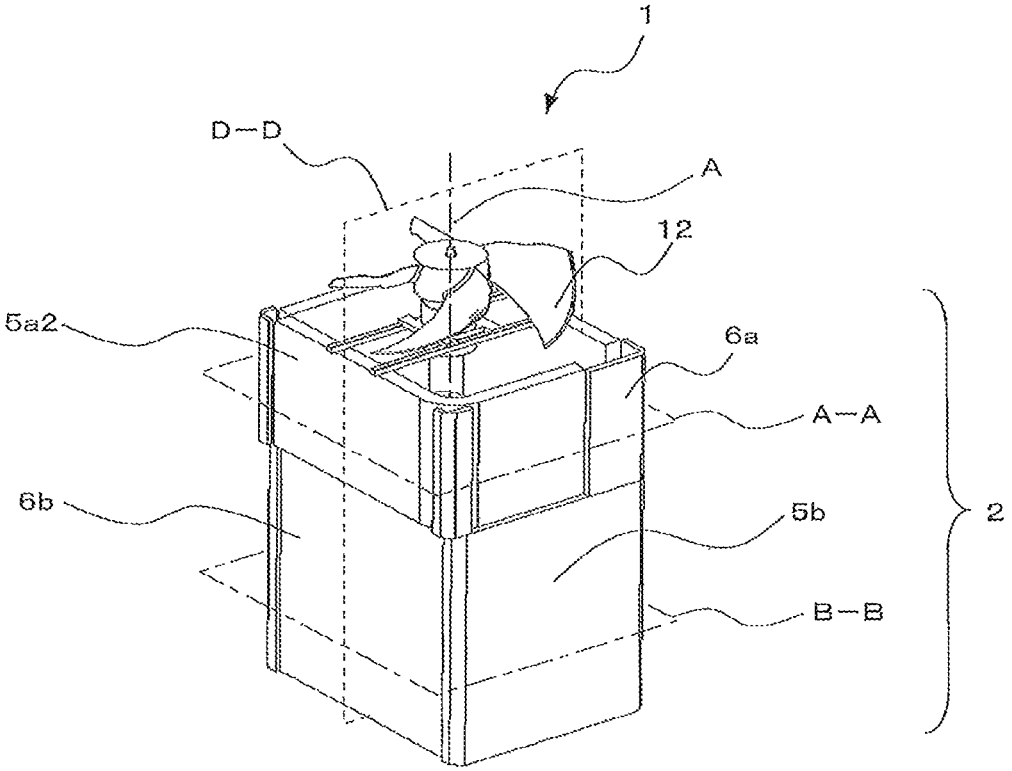
FIG. 10 is a diagram for description of cross sections and a longitudinal section of the outdoor unit of the air-conditioning apparatus according to Embodiment 2 of the present invention.
Figure 10A:
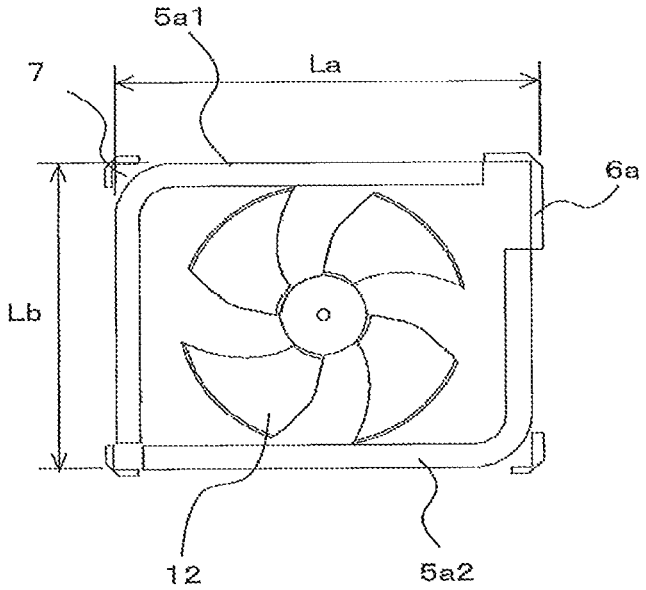
FIG. 10*a* is a schematic diagram of section A-A in FIG. 10.
Figure 10B:
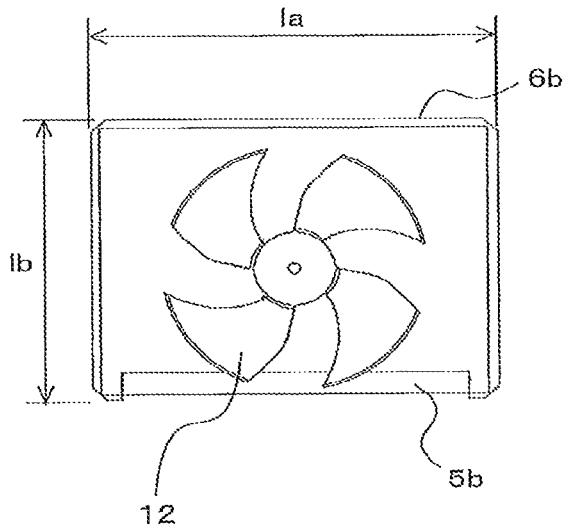
FIG. 10*b* is a schematic diagram of section B-B in FIG. 10.
Figure 10C:
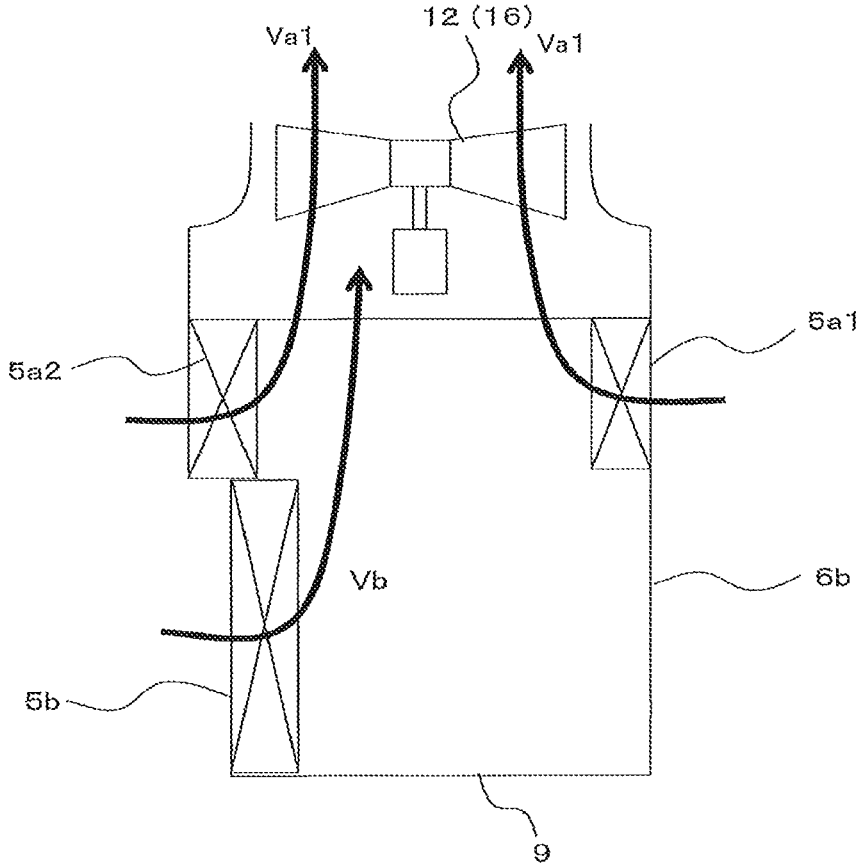
FIG. 10*c* is a schematic diagram of section D-D in FIG. 10.

FIG. 9 is a perspective view of the outdoor unit 1 of the air-conditioning apparatus according to Embodiment 2 of the present invention, from which the upper surface of the housing 2 is removed. FIG. 10 is a diagram for description of cross sections and a longitudinal section of the outdoor unit 1 of the air-conditioning apparatus according to Embodiment 2 of the present invention. FIG. 10*a* is a schematic diagram of section A-A in FIG. 10. FIG. 10*b* is a schematic diagram of section B-B in FIG. 10. FIG. 10*c* is a schematic diagram of section D-D in FIG. 10.

FIGS. 10*a* and 10*b* are each a schematic diagram of a cross section of the housing 2 taken along the direction orthogonal to the direction of the axis line A of the fan 12. FIG. 10*a* is a section schematic diagram of the upper part of the housing 2. FIG. 10*b* is a section schematic diagram of the lower part of the housing 2. FIGS. 10*a* and 10*b* each illustrate the fan 12 to indicate the positional relation between the fan 12 and the heat exchanger 5. FIG. 10*c* is a schematic diagram of a longitudinal section of the housing 2 taken along the direction of the axis line A of the fan 12, and is a schematic diagram of a section of the housing 2 in the short-side direction including the axis line A of the fan 12.

In the outdoor unit 1 of the air-conditioning apparatus according to the present Embodiment 2, the position of the lower heat exchanger 5*b* disposed in the lower part of the housing 2 is different from that in Embodiment 1 as illustrated in FIGS. 10*b* and 10*c*.

In the present Embodiment 2, as illustrated in FIG. 10*a*, the upper heat exchanger 5*a*, the upper side-surface panel 6*a* substantially L-shaped in plan view, and the supports 7 each substantially L-shaped in plan view serve as the side surfaces of the upper part of the housing 2. The upper heat exchanger 5*a* includes the two upper heat exchangers 5*a*1 and 5*a*2 each substantially L-shaped in plan view and disposed to serve as the four side surfaces of the upper part of the housing 2.

As illustrated in FIG. 10*b*, the lower heat exchanger 5*b* and the lower side-surface panel 6*b* substantially U-shaped in plan view serve as the side surfaces of the lower part of the housing 2. The lower heat exchanger 5*b* has a flat plate shape and is disposed to serve as one side surface in the short-side direction among the four side surfaces of the lower part of the housing 2.

Housing widths at the upper and lower parts of the housing 2 of the outdoor unit 1 according to the present Embodiment 2 are related to the internal air path of the outdoor unit 1 as described later, and thus are defined, by any component serving as the air path. Specifically, the housing widths are defined by the lengths of outer surfaces of the upper heat exchanger 5*a*, the lower heat exchanger 5*b*, the upper side-surface panel 6*a*, and the lower side-surface panel 6*b* serving as the side surfaces of the housing 2, or by the distance between the outer surfaces of the side surfaces facing to each other, but are not defined by each distance between the supports 7 at the corners of the housing 2.

As illustrated in FIG. 10*a*, the horizontal width La and the vertical width Lb have different lengths in the section at the upper part of the housing 2. The horizontal width La is the housing width of the upper part of the housing 2 in the long-side direction, and the vertical width Lb is the housing width of the upper part of the housing 2 in the short-side direction.

The horizontal width La in the section at the upper part of the housing 2 is defined by the distance between the outer surfaces of the upper heat exchanger 5*a*1 and the upper side-surface panel 6*a* facing to the upper heat exchanger 5*a*1. The vertical width Lb is defined by the distance between the outer surfaces of the upper heat exchangers 5*a*1 and 5*a*2.

As illustrated in FIG. 10*b*, the horizontal width la and the vertical width lb have different lengths in the section at the lower part of the housing 2. The horizontal width la is the housing width of the lower part of the housing 2 in the long-side direction, and the vertical width lb is the housing width of the lower part of the housing 2 in the short-side direction.

The horizontal width la in the section at the lower part of the housing 2 is defined by the length of the outer surface of the side-surface panel 6 facing to the lower heat exchanger 5*b* in the lateral direction. The vertical width lb is defined by the length of the outer surface of the side-surface panel 6 disposed perpendicular to the lower heat exchanger 5*b* in the short-side direction.

In the outdoor unit 1 of the air-conditioning apparatus according to the present Embodiment 2, the horizontal widths La and la are longer than the vertical widths Lb and lb, and the vertical width Lb is longer than the vertical width lb. The horizontal width La is equal to the horizontal width la.

As illustrated in FIG. 10*c*, the outer surfaces of the upper heat exchanger 5*a*2 and the lower heat exchanger 5*b* are disposed at positions shifted from each other in the short-side direction on one side surface of the outdoor unit 1 in the short-side direction such that the outer surface of the lower heat exchanger 5*b* is shifted further on the inner side of the housing 2 than the outer surface of the upper heat exchanger 5*a*2 is. The outer surfaces of the side-surface panel 6 and the upper heat exchanger 5*a*1 are aligned with each other in the short-side direction on the other side surface of the outdoor unit 1 in the short-side direction.

In the present Embodiment 2, similarly to Embodiment 1, the vertical width Lb of the upper part of the housing 2, at which the upper heat exchangers 5*a* disposed closer to the fan 12 serve as the four side surfaces, is longer than the vertical width lb of the lower part of the housing 2, at which the lower heat exchanger 5*b* disposed farther from the fan 12 serves as one side surface. This configuration leads to increase in the space around the fan 12 (the air path at the upper part of the housing 2), and allows the distance between the axis line A of the fan 12 and each upper heat exchanger 5*a* to be more uniform between the short-side direction and the long-side direction, thereby achieving more uniform suction wind speed distribution in the rotational direction of the fan 12. Consequently, the outdoor unit 1 of the air-conditioning apparatus, which can achieve noise reduction of the fan 12 and improved heat exchange efficiency, is achieved, In the present Embodiment 2, as the lower heat exchanger 5*b* is shifted further on the inner side of the housing 2 than the upper heat exchanger 5*a*2 is as illustrated in FIG. 10*c*, the wind Vb having passed through the lower heat exchanger 5*b* moves further on the inner side of the vanes 16 of the fan 12 than the wind Va1 having passed through the upper heat exchanger 5*a*2. This configuration achieves more uniform wind speed distribution of upward airflow passing through the heat exchanger 5 in the short-side direction.

As the outer surface of the lower heat exchanger 5*b* is shifted on the inner side of the housing 2 as compared to Embodiment 1, the flow rate of airflow toward the fan 12 through the lower heat exchanger 5*b* is larger than the flow rate of airflow on the lower surface of the outdoor unit 1. Consequently, airflow on the inner side of the vanes 16 of the fan 12 increases as compared to Embodiment 1, which leads to more uniform flow right before suction by the fan 12, thereby reducing disorder to achieve noise reduction of the fan 12.

Embodiment 3

The following describes Embodiment 3 of the present invention. Any duplicate description of Embodiments 1 and 2 will be (partially) omitted, and any part identical to or equivalent to those in Embodiments 1 and 2 is denoted by an identical reference sign.

Figure 11:
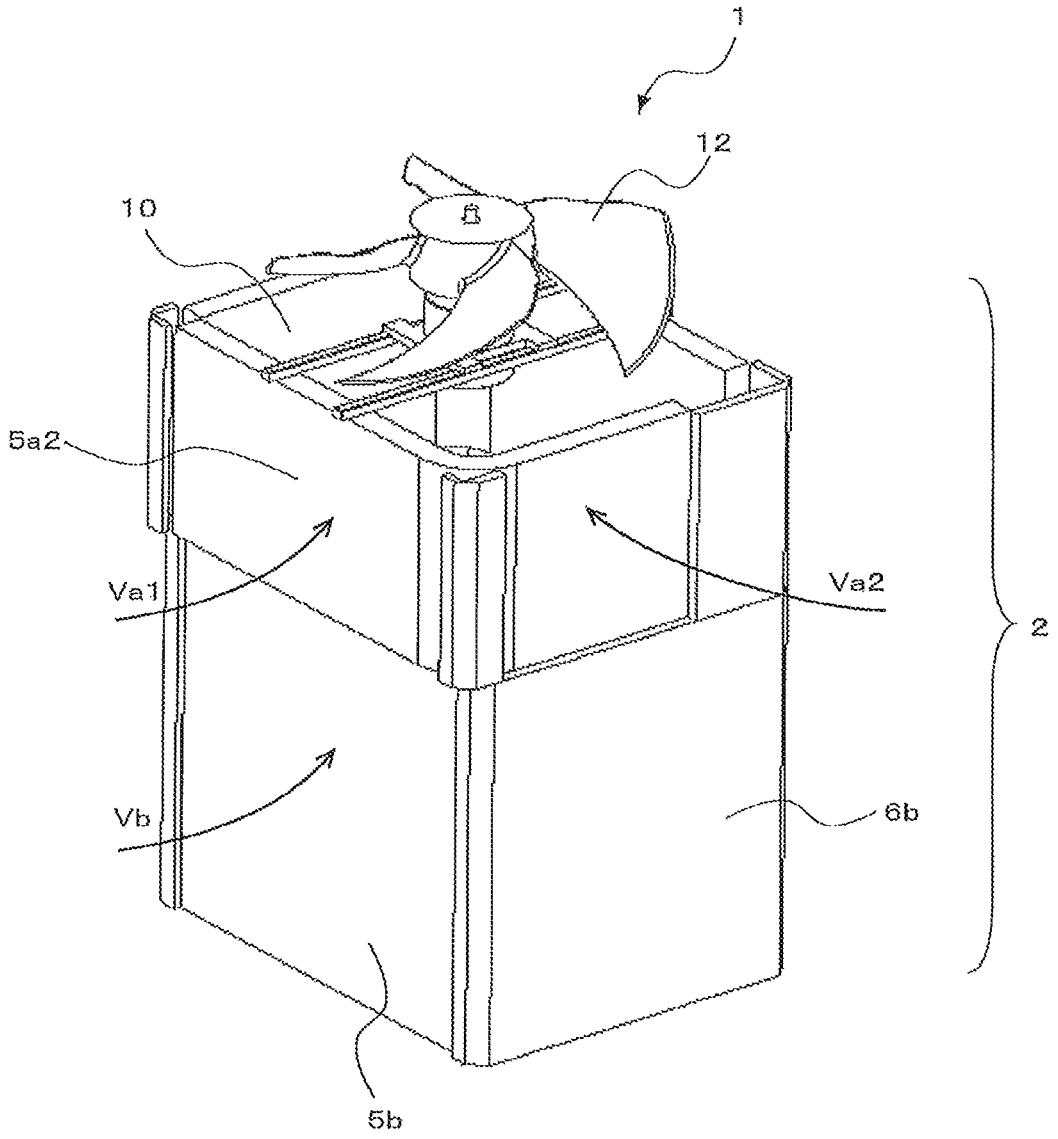
FIG. 11 is a perspective view of the outdoor unit of the air-conditioning apparatus according to Embodiment 3 of the present invention, from which the upper surface of the housing is removed
Figure 12:
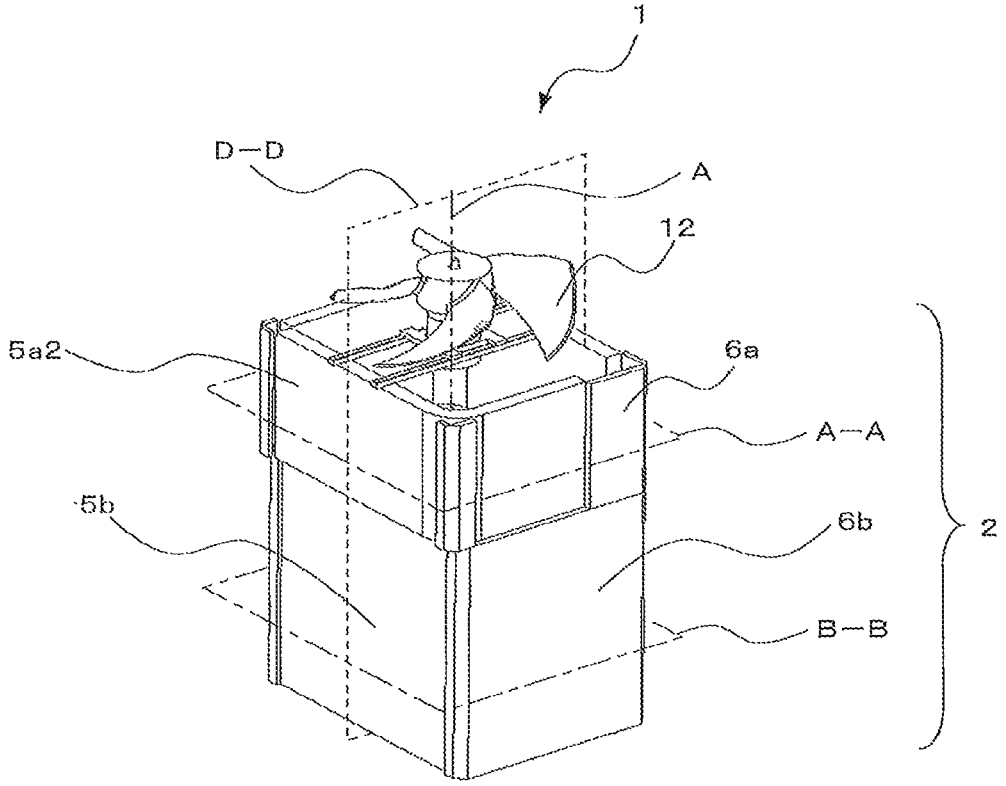
FIG. 12 is a diagram for description of cross sections and a longitudinal section of the outdoor unit of the air-conditioning apparatus according to Embodiment 3 of the present invention.
Figure 12A:
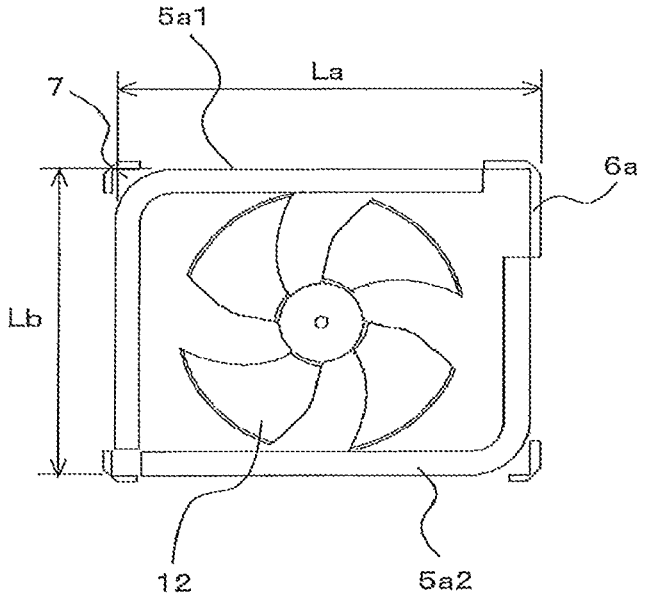
FIG. 12*a* is a schematic diagram of section A-A in FIG. 12.
Figure 12B:
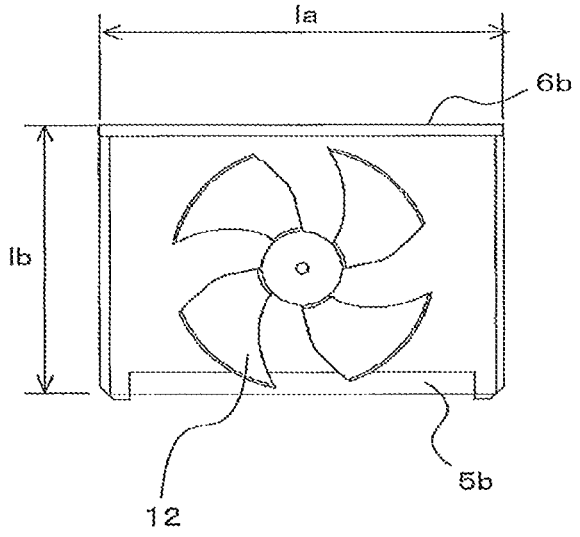
FIG. 12*b* is a schematic diagram of section B-B in FIG. 12.
Figure 12C:
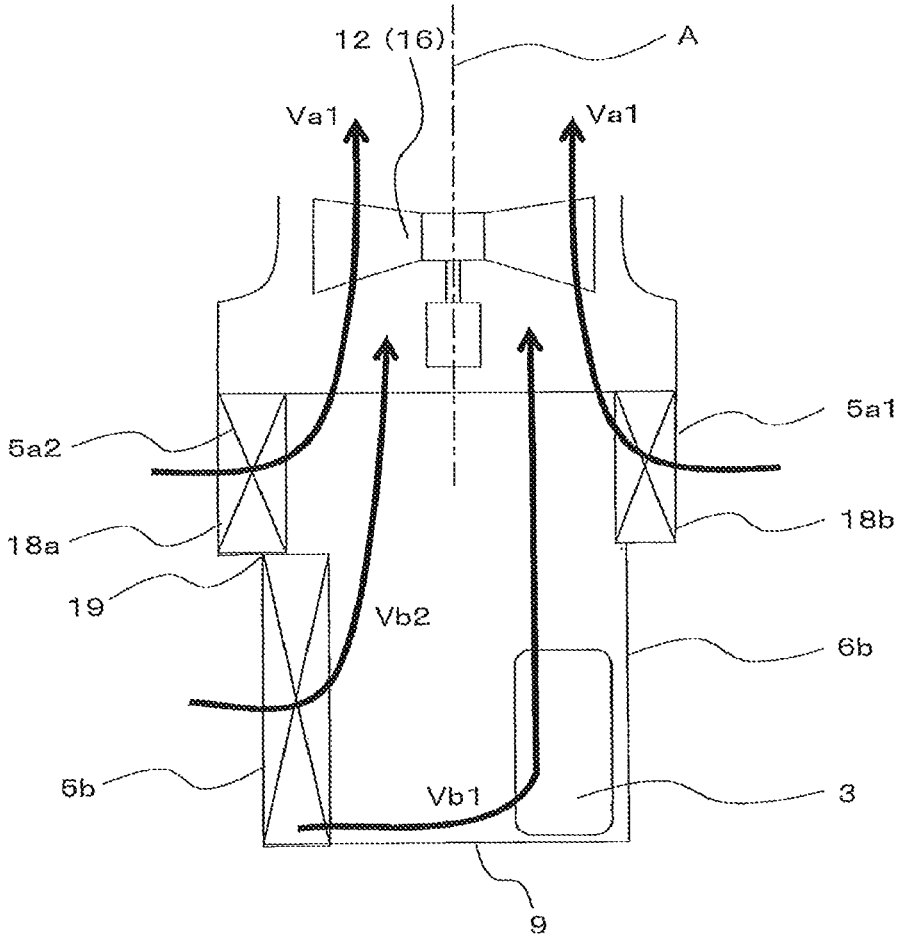
FIG. 12*c* is a schematic diagram of section D-D in FIG. 12.

FIG. 11 is a perspective view of the outdoor unit 1 of the air-conditioning apparatus according to Embodiment 3 of the present invention, from which the upper surface of the housing 2 is removed, FIG. 12 is a diagram for description of cross sections and a longitudinal section of the outdoor unit 1 of the air-conditioning apparatus according to Embodiment 3 of the present invention. FIG. 12*a* is a schematic diagram of section A-A in FIG. 12. FIG. 12*b* is a schematic diagram of section B-B in FIG. 12. FIG. 12*c* is a schematic diagram of section D-D in FIG. 12.

FIGS. 12*a* and 12*b* are each a schematic diagram of a cross section of the housing 2 taken along the direction orthogonal to the direction of the axis line A of the fan 12. FIG. 12*a* is a section schematic diagram of the upper part of the housing 2. FIG. 12*b* is a section schematic diagram of the lower part of the housing 2. FIGS. 12*a* and 12*b* each illustrate the fan 12 to indicate the positional relation between the fan 12 and the heat exchanger 5. FIG. 12*c* is a schematic diagram of a longitudinal section of the housing 2 taken along the direction of the axis line A of the fan 12, and is a schematic diagram of a section of the housing 2 in the short-side direction including the axis line A of the fan 12.

In the outdoor unit 1 of the air-conditioning apparatus according to, the present Embodiment 3, the lower side-surface panel 6*b* serving as the lower part of the housing 2 is disposed at a position different from that in Embodiment 2 as illustrated in FIG. 12*c*.

In the present Embodiment 3, as illustrated in FIG. 12*a*, the upper heat exchanger 5*a*, the upper side-surface panel 6*a* substantially L-shaped in plan view, and the supports 7 each substantially L-shaped in plan view serve as the side surfaces of the upper part of the housing 2. The upper heat exchanger Sc includes the two upper heat exchangers 5*a*1 and 5*a*2 each substantially L-shaped in plan view and disposed to serve as the four side surfaces of the upper part of the housing 2.

As illustrated in FIG. 12*b* the lower heat exchanger 5*b* and the lower side-surface panel 6*b* substantially U-shaped in plan view serve as the side surfaces of the lower part of the housing 2. The lower heat exchanger 5*b* has a flat plate shape and is disposed to serve as one side surface in the short-side direction among the four side surfaces of the lower part of the housing 2.

Housing widths at the upper and lower parts of the housing 2 of the outdoor unit 1 according to the present Embodiment 3 are related to the internal air path of the outdoor unit 1 as described later, and thus are defined by any component serving as the air path. Specifically, the housing widths are defined by the lengths of outer surfaces of the upper heat exchanger 5*a*, the lower heat exchanger 5*b*, the upper side-surface panel 6*a*, and the lower side-surface panel 6*b* sewing as the side surfaces of the housing 2, or by the distance between the outer surfaces of the side surfaces facing to each other, but are not defined by each distance between the supports 7 at the corners of the housing 2.

As illustrated in FIG. 12*a*, the horizontal width La and the vertical width Lb have different lengths in the section at the upper part of the housing 2. The horizontal width La is the housing width of the upper part of the housing 2 in the long-side direction, and the vertical width Lb is the housing width of the upper part of the housing 2 in the short-side direction.

The horizontal width La in the section at the upper part of the housing 2 is defined by the distance between the outer surfaces of the upper heat exchanger 5*a*1 and the upper side-surface panel ea facing to the upper heat exchanger 5*a*1. The vertical width Lb is defined by the distance between the outer surfaces of the upper heat exchangers 5*a*1 and 5*a*2.

As illustrated in FIG. 12*b*, the horizontal width la and the vertical width lb have different lengths in the section at the lower part of the housing 2. The horizontal width la is the housing width of the lower part of the housing 2 in the long-side direction, and the vertical width lb is the housing width of the lower part of the housing 2 in the short-side direction.

The horizontal width la in the section at the lower part of the housing 2 is defined by the length of the side-surface panel 6 facing to the lower heat exchanger 5*b* in the lateral direction. The vertical width lb is defined by the length of the outer surface of the side-surface panel 6 disposed perpendicular to the lower heat exchanger 5*b* in the short-side direction.

In the outdoor unit 1 of the air-conditioning apparatus according to the present Embodiment 3, the horizontal widths La and la are longer than the vertical widths Lb and lb, and the vertical width Lb is longer than the vertical width lb. The horizontal width La is equal to the horizontal width la.

As illustrated in FIG. 12*c*, the outer surfaces of the upper heat exchanger 5*a*2 and the lower heat exchanger 5*b* are disposed at positions shifted from each other in the short-side direction on one side surface of the outdoor unit 1 in the short-side direction such that the outer surface of the lower heat exchanger 5*b* is disposed further on the inner side of the housing 2 than the outer surface of the upper heat exchanger 5*a*2 is. The outer surfaces of the lower side-surface panel 6*b* and the upper heat exchanger 5*a*1 are disposed at positions shifted from each other in the short-side direction on the other side surface of the outdoor unit 1 in the short-side direction such that the outer surface of the lower side-surface panel 6*b* is disposed further on the inner side of the housing 2 than the outer surface of the upper heat exchanger 5*a*1 is.

In the present Embodiment 3, similarly to Embodiments 1 and 2, the vertical width Lb of the upper part of the housing 2, at which the upper heat exchangers 5*a* disposed closer to the fan 12 serve as the four side surfaces, is longer than the vertical width lb of the lower part of the housing 2, at which the lower heat exchanger 5*b* disposed farther from the fan 12 serves as one side surface. This configuration leads to increase in the space around the fan 12 (the air path at the upper part of the housing 2), and allows the distance between the axis line A of the fan 12 and each upper heat exchanger 5*a* to be more uniform between the short-side direction and the long-side direction, thereby achieving more uniform suction wind speed distribution in the rotational direction of the fan 12. Consequently, the outdoor unit 1 of the air-conditioning apparatus, which can achieve noise reduction of the fan 12 and improved heat exchange efficiency, is achieved.

In the present Embodiment 3, as the lower heat exchanger 5*b* is shifted further on the inner side of the housing 2 than the upper heat, exchanger 5*a*2 is as illustrated in FIG. 12*c*, the wind Vb having passed through the lower heat exchanger 5*b* moves further on the inner side of the vanes 16 of the fan 12 than the wind Va1 having passed through the upper heat exchanger 5*a*2. This configuration achieves more uniform wind speed distribution of upward airflow passing through the heat exchanger 5 in the short-side direction.

The wind Vb1 as a part, of the wind Vb having passed through the lower heat exchanger 5*b* flows on the bottom plate 9 on which the built-in devices 3 such as a compressor is placed, and then flows upward along the lower side-surface panel 6*b*. When the lower side-surface panel 6*b* is shifted on the inner side of the upper heat exchanger 5*a*1, the wind Vb1 as the part of the wind Vb having passed through the lower heat exchanger 5*b* moves further on the inner side of the vanes 16 of the fan 12 than the wind Va1 having passed through the upper heat exchanger 5*a*1. This configuration achieves more uniform wind speed distribution of upward airflow passing through the heat exchanger 5 in the short-side direction in the present Embodiment 3 than that in Embodiment 2.

Embodiment 4

The following describes Embodiment 4 of the present invention. Any duplicate description of Embodiments 1 to 3 will be (partially) omitted, and any part identical to or equivalent to those in Embodiments 1 to 3 is denoted by an identical reference sign.

Figure 13:
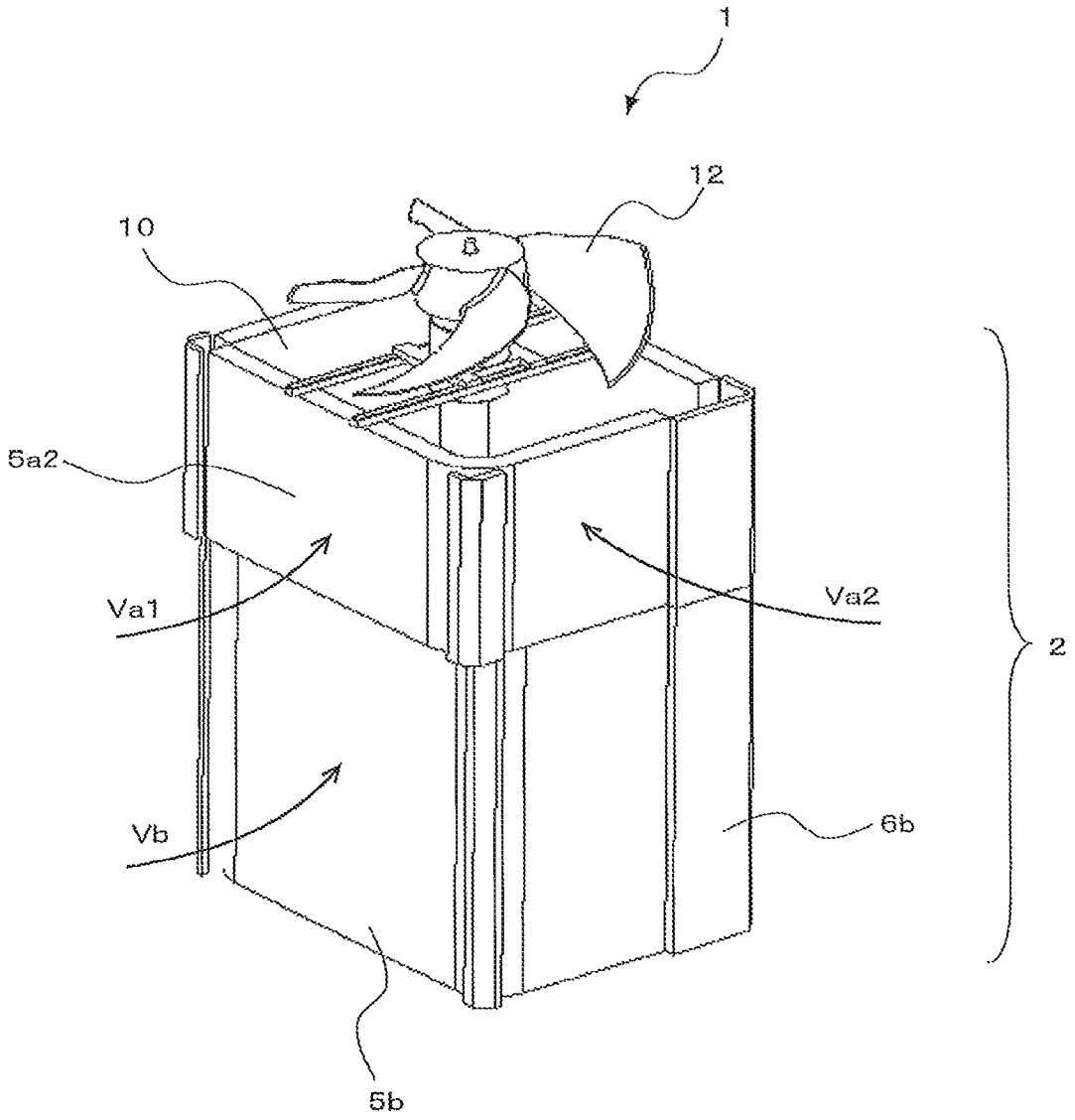
FIG. 13 is a perspective view of the outdoor unit of the air-conditioning apparatus according to Embodiment 4 of the present invention, from which the upper surface of the housing is removed
Figure 14:
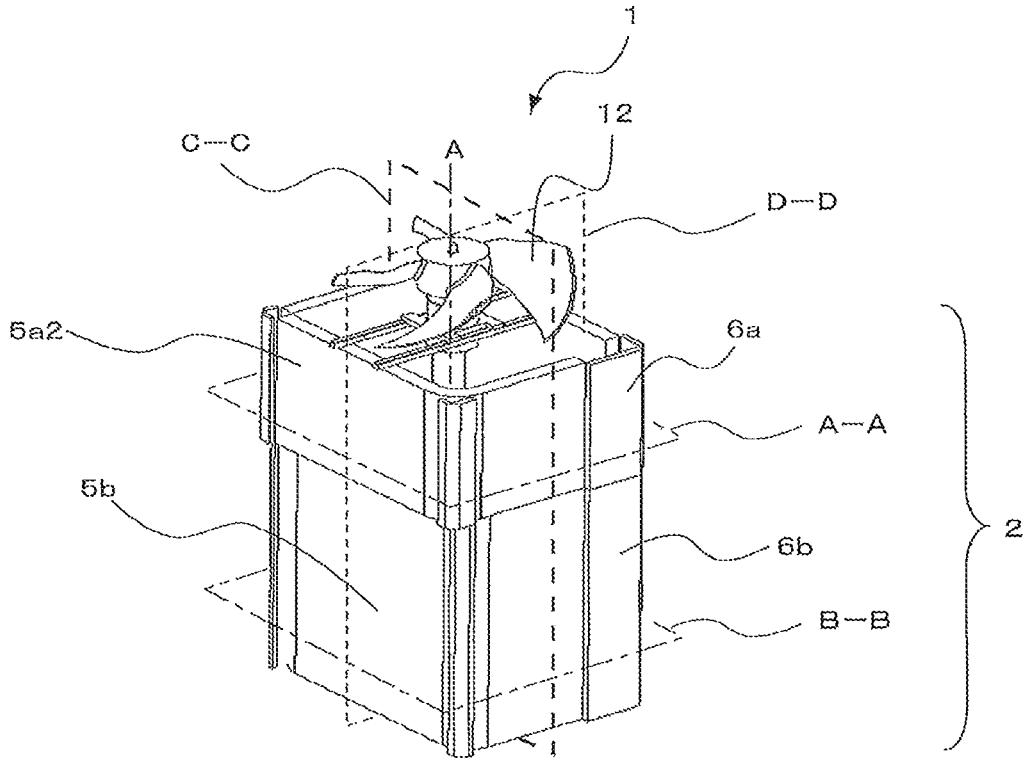
FIG. 14 is a diagram for description of cross sections and longitudinal sections of the outdoor unit of the air-conditioning apparatus according to Embodiment 4 of the present invention.
Figure 14A:
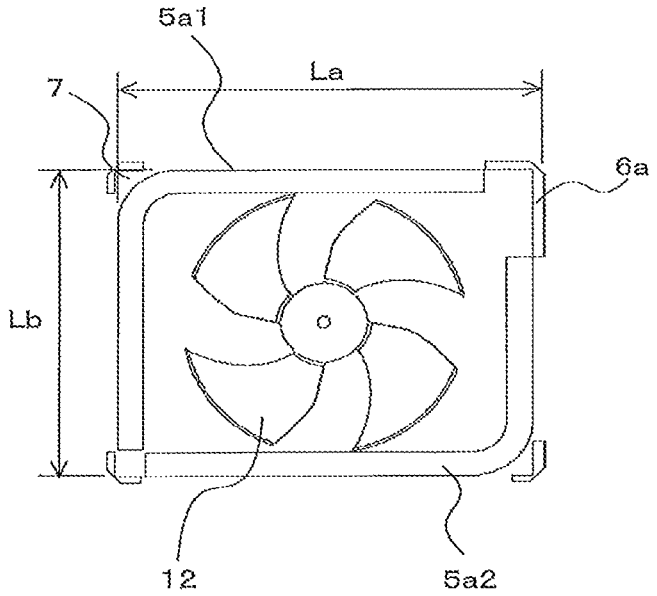
FIG. 14*a* is a schematic diagram of section A-A in FIG. 14.
Figure 14B:
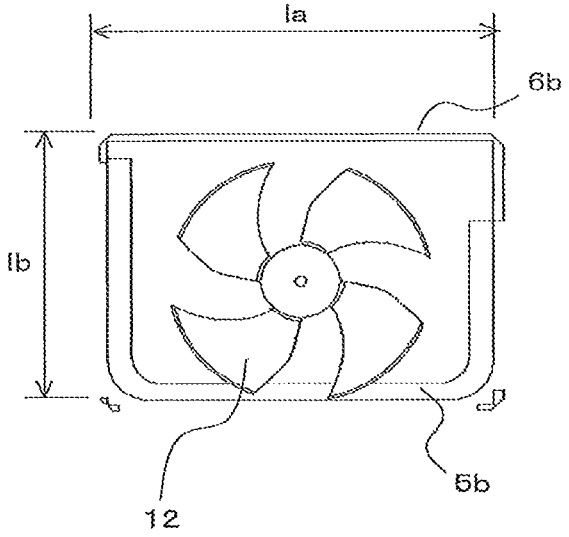
FIG. 14*b* is a schematic diagram of section B-B in FIG. 14.
Figure 14C:
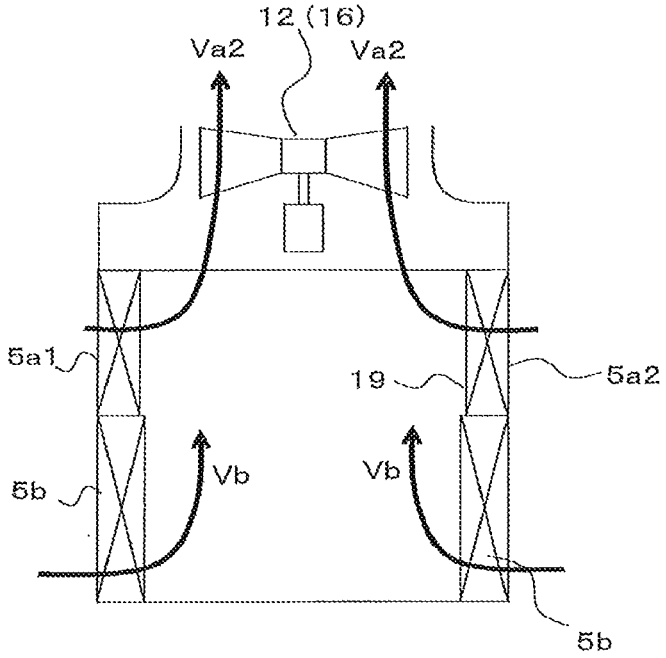
FIG. 14*c* is a schematic diagram of section C-C in FIG. 14.
Figure 14D:
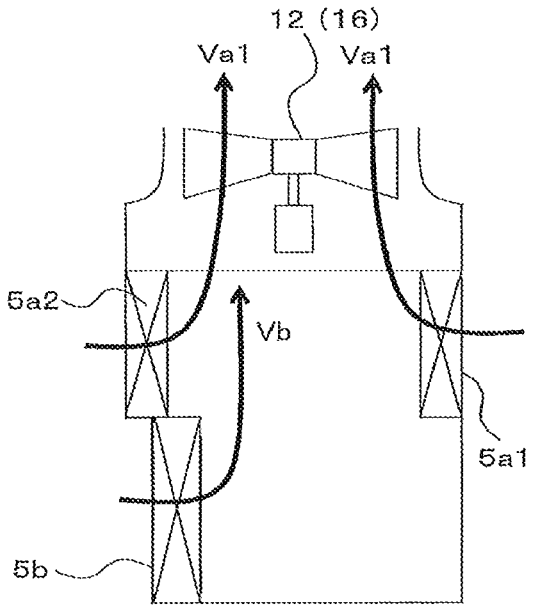
FIG. 14*d* is a schematic diagram of section D-D in FIG. 14.

FIG. 13 is a perspective view of the outdoor unit 1 of the air-conditioning apparatus according to Embodiment 4 of the present invention, from which the upper surface of the housing 2 is removed. FIG. 14 is a diagram for description of cross sections and longitudinal sections of the outdoor unit 1 of the air-conditioning apparatus according to Embodiment 4 of the present invention. FIG. 14*a* is a schematic diagram of section A-A in FIG. 14. FIG. 14*b* is a schematic diagram of section B-B in FIG. 14. FIG. 14*c* is a schematic diagram of section C-C in FIG. 14. FIG. 14*d* is a schematic diagram of section D-D in FIG. 14.

FIGS. 14*a* and 14*b* are each a schematic diagram of a cross section of the housing 2 taken along the direction orthogonal to the direction of the axis line A of the fan 12. FIG. 14*a* is a section schematic diagram of the upper part of the housing 2. FIG. 14*b* is a section schematic diagram of the lower part of the housing 2. FIGS. 14*a* and 14*b* each illustrate the fan 12 to indicate the positional relation between the fan 12 and the heat exchanger 5. FIGS. 14*c* and 14*d* are each a schematic diagram of a longitudinal section of the housing 2 taken along the direction parallel to the direction of the axis line A of the fan 12. FIG. 14*c* is a schematic diagram of a section in the long-side direction including the axis line A of the fan 12. FIG. 14*d* is a schematic diagram of a section in the short-side direction including the axis line A of the fan 12.

In the outdoor unit 1 of the air-conditioning apparatus according to the present Embodiment 4, the lower heat exchanger 5*b* and the side-surface panel 6 serving the lower part of the housing 2 have shapes different from those in Embodiment 3 as illustrated in FIG. 14*b*.

In the present Embodiment 4, as illustrated in FIG. 14*a*, the upper heat exchanger 5*a*, the upper side-surface panel 6*a* substantially L-shaped in plan view, and the supports 7 each substantially L-shaped in plan view serve as the side surfaces of the upper part of the housing 2. The upper heat exchanger 5*a* includes the two upper heat exchangers 5*a*1 and 5*a*2 each substantially L-shaped in plan view and disposed to serve as the four side surfaces of the upper part of the housing 2.

As illustrated in FIG. 14*b*, the lower heat exchanger 5*b* and the lower side-surface panel 6*b* substantially L-shaped in plan view serve as the side surfaces of the lower part of the housing 2. The lower heat exchanger 5*b* is substantially inverse-J-shaped in plan view and disposed to serve as both surfaces in the long-side direction and one side surface in the short-side direction among the four side surfaces of the lower part of the housing 2.

Housing widths at the upper and lower parts of the housing 2 of the outdoor unit 1 according to the present Embodiment 4 are related to the internal air path of the outdoor unit 1 as described later, and thus are defined by any component serving as the air path. Specifically, the housing widths are defined by the lengths of outer surfaces of the upper heat exchanger 5*a*, the lower heat exchanger 5*b*, the upper side-surface panel 6*a*, and the lower side-surface panel 6*b* serving as the side surfaces of the housing 2, or by the distance between the outer surfaces of the side surfaces facing to each other, but are not defined by each distance between the supports 7 at the corners of the housing 2.

As illustrated in FIG. 14*a*, the horizontal width La and the vertical width Lb have different lengths in the section at the upper part of the housing 2. The horizontal width La is the housing width of the upper part of the housing 2 in the long-side direction, and the vertical width Lb is the housing width of the upper part of the housing 2 in the short-side direction.

The horizontal width La in the section at the upper part of the housing 2 is defined by the distance between the outer surfaces of the upper heat exchanger 5*a*1 and the upper side-surface panel 6*a* facing to the upper heat exchanger 5*a*1. The vertical width Lb is defined by the distance between the outer surfaces of the upper heat exchangers 5*a*1 and 5*a*2.

As illustrated in FIG. 14*b*, the horizontal width la and the vertical width lb have different lengths in the section at the lower part of the housing 2. The horizontal width la is the housing width of the lower part of the housing 2 in the long-side direction, and the vertical width lb is the housing width of the lower part of the housing 2 in the short-side direction.

The horizontal width la in the section at the lower part of the housing 2 is defined by the length of the outer surface of the lower side-surface panel 6*b* in the long-side direction. The vertical width lb is defined by the distance between the outer surfaces of the lower heat exchanger 5*b* and the lower side-surface panel 6*b* facing to the lower heat exchanger 5*b* in the short-side direction, In the outdoor unit 1 of the air-conditioning apparatus according to the present Embodiment 4, the horizontal widths La and la are longer than the vertical widths Lb and lb, and the vertical width Lb is longer than the vertical width lb. The horizontal width La is equal to the horizontal width la.

As illustrated in FIG. 14*d*, the outer surfaces of the upper heat exchanger 5*a*2 and the lower heat exchanger 5*b* are disposed at positions shifted from each other in the short-side direction on one side surface of the outdoor unit 1 in the short-side direction, and the outer surface of the lower heat exchanger 5*b* is disposed further on the inner side of the housing 2 than the outer surface of the upper heat exchanger 5*a*2 is. As illustrated in FIG. 14*c*, the outer surfaces of each of the upper heat exchangers 5*a*1 and 5*a*2 and the lower heat exchanger 5*b* are aligned with each other in the long-side direction on both side surfaces of the outdoor unit 1 in the long-side direction.

In the present Embodiment 4, as the lower heat exchanger 5*b* is shifted further on the inner side of the housing 2 than the upper heat exchanger 5*a*2 is as illustrated in FIG. 14*d*, the wind Vb having passed through the lower heat exchanger 5*b* moves further on the inner side of the vanes 16 of the fan 12 than the wind Va1 having passed through the upper heat exchanger 5*a*2. This configuration achieves more uniform wind speed distribution of upward airflow passing through the heat exchanger 5 in the short-side direction, which leads to more uniform flow right before suction by the fan 12, thereby reducing disorder to achieve noise reduction of the fan 12. Consequently, the outdoor unit 1 of the air-conditioning apparatus, which can achieve noise reduction of the fan 12 and improved heat exchange efficiency, is achieved.

The distance between the upper heat exchanger 5*a* and the axis line A of the fan 12 in the long-side direction is so long that the wind Va2 having passed through the upper heat exchanger 5*a* and the wind Vb having passed through the lower heat exchanger 5*b* are mixed in the radial direction of the fan 12 before being sucked by the fan 12 (in other words, the winds are made uniform). Thus, the housing width is increased only in the short-side direction in the present Embodiment 4.

In the present Embodiment 4, the lower heat exchangers 5*b* are disposed in three of the four side surfaces of the lower part of the housing 2 and thus mounted in a large volume as compared to Embodiments 1 to 3 in which the lower heat exchanger 5*b* is disposed only in one side surface. Consequently, an increased capacity can be achieved, and a pressure drop in the outdoor unit 1 can be reduced due to an increased area through which airflow passes, which leads to reduction of power necessary for air-sending.

Embodiment 5

The following describes Embodiment 5 of the present invention. Any duplicate description of Embodiments 1 to 4 will be (partially) omitted, and any part identical to or equivalent to those in Embodiments 1 to 4 is denoted by an identical reference sign.

Figure 15:
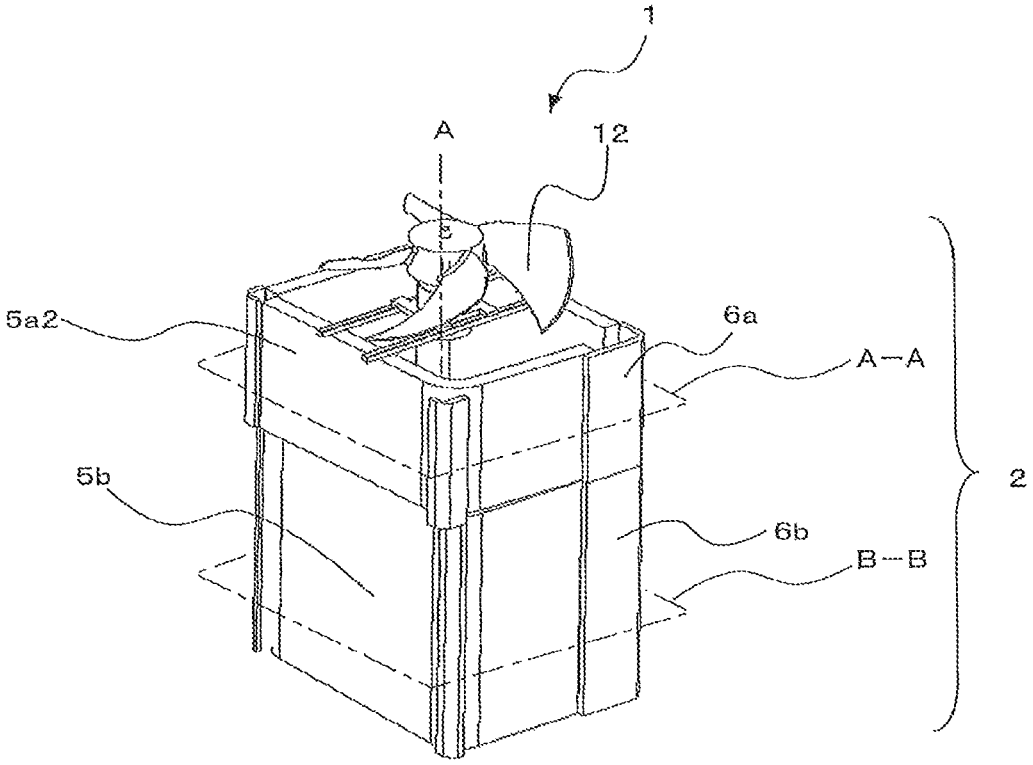
FIG. 15 is a diagram for description of cross sections of the outdoor unit of the air-conditioning apparatus according to Embodiment 5 of the present invention.
Figure 15A:
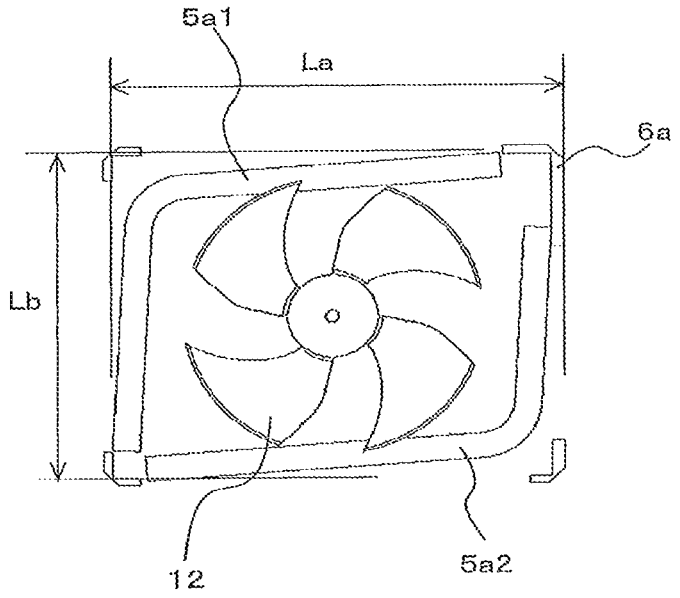
FIG. 15*a* is a schematic diagram of section A-A in FIG. 15.
Figure 15B:
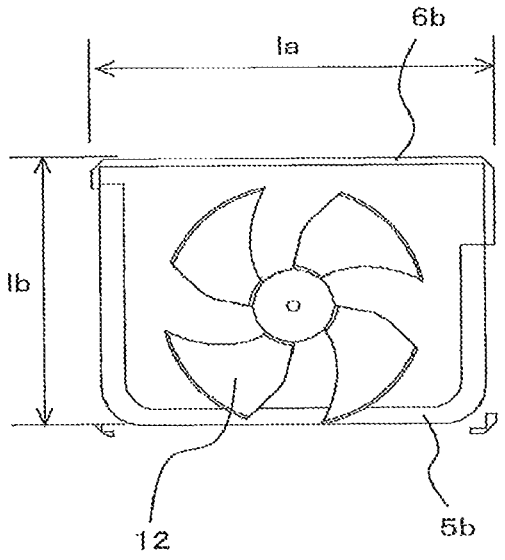
FIG. 15*b* is a schematic diagram of section B-B in FIG. 15.
Figure 16:
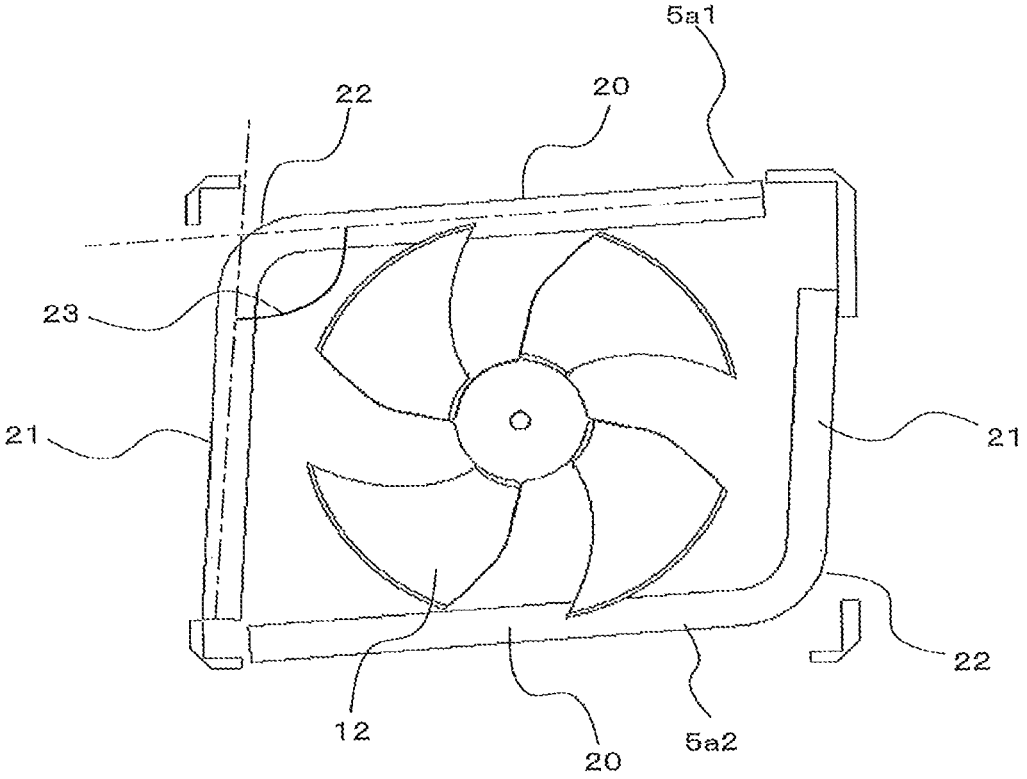
FIG. 16 is an enlarged view of FIG. 15*a*.
Figure 17:
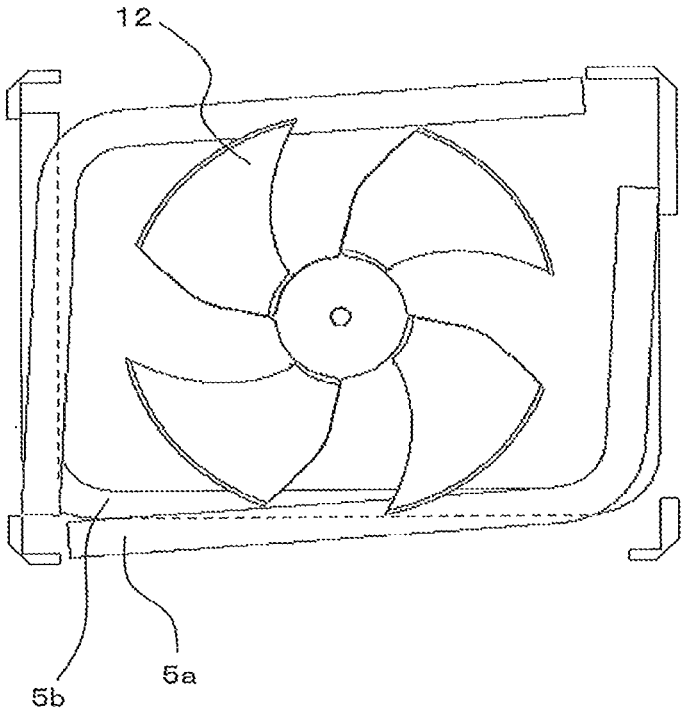
FIG. 17 is a diagram illustrating a state in which the section schematic diagram in FIG. 15*a* and the section schematic diagram in FIG. 15*b* are placed over each other.
Figure 18:
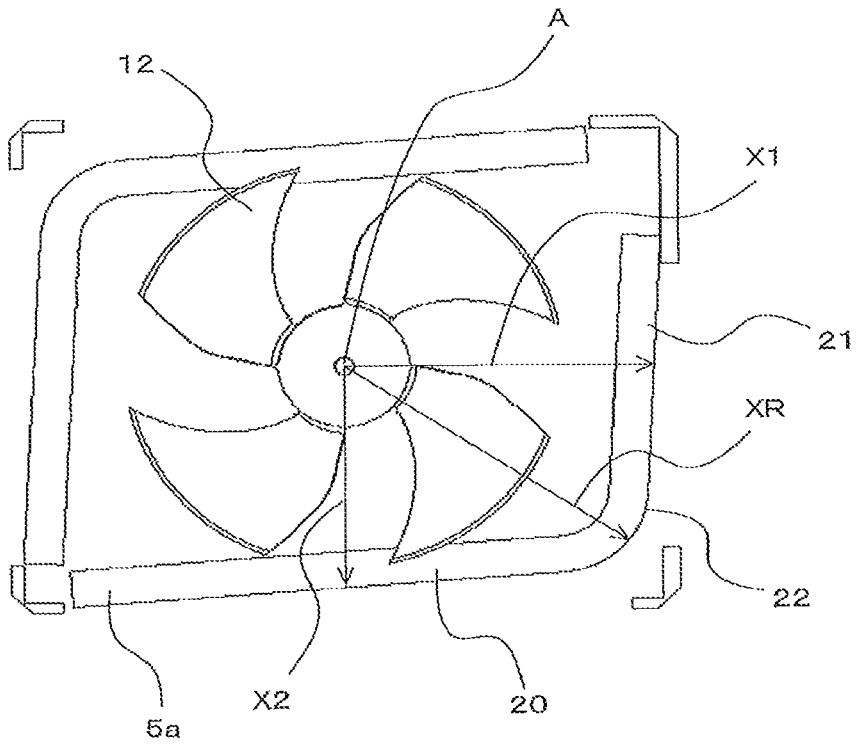
FIG. 18 is an explanatory diagram of FIG. 15*a*.

FIG. 15 is a diagram for description of cross sections of the outdoor unit 1 of the air-conditioning apparatus according to Embodiment 5 of the present invention. FIG. 15*a* is a schematic diagram of section A-A in FIG. 15. FIG. 15*b* is a schematic diagram of section B-B in FIG. 15. FIG. 16 is an enlarged view of FIG. 15*a*. FIG. 17 is a diagram of a state in which the section schematic diagram in FIG. 15*a* and the section schematic diagram in FIG. 15*b* are placed over each other. FIG. 18 is an explanatory diagram of FIG. 15*a*.

FIGS. 15*a* and 15*b* are each a schematic diagram of a cross section of the housing 2 taken along the direction orthogonal to the direction of the axis line A of the fan 12. FIG. 15*a* is a section schematic diagram of the upper part of the housing 2. FIG. 15*b* is a section schematic diagram of the lower part of the housing 2. FIGS. 15 to 18 each illustrate the fan 12 to indicate the positional relation between the fan 12 and the heat exchanger 5.

In the outdoor unit 1 of the air-conditioning apparatus according to the present Embodiment 5, the upper heat exchangers 5*a*1 and 5*a*2 serving as the upper part of the housing 2 have shapes different from those in Embodiment 4 as illustrated in FIGS. 15 to 18, whereas any other configuration is the same.

In the present Embodiment 5, as illustrated in FIG. 15*a*, the upper heat exchanger 5*a*, the upper side-surface panel 6*a* substantially L-shaped in plan view, and the supports 7 each substantially L-shaped in plan view serve as the side surfaces of the upper part of the housing 2. The upper heat exchanger 5*a* includes the two upper heat exchangers 5*a*1 and 5*a*2 each substantially L-shaped in plan view and disposed to serve as the four side surfaces of the upper part of the housing 2.

As illustrated in FIG. 15*b*, the lower heat exchanger 5*b* and the lower side-surface panel 6*b* substantially L-shaped in plan view serve as the side surfaces of the lower part of the housing 2. The lower heat exchanger 5*b* is substantially inverse-J-shaped in plan view and disposed to serve as both surfaces in the long-side direction and one side surface in the short-side direction among the four side surfaces of the lower part of the housing 2.

Housing widths at the upper and lower parts of the housing 2 of the outdoor unit 1 according to the present Embodiment 5 are related to the internal air path of the outdoor unit 1 as described later, and thus are defined by any component serving as the air path. Specifically, the housing widths are defined by the lengths of outer surfaces of the upper heat exchanger 5*a*, the lower heat exchanger 5*b*, the upper side-surface panel 6*a*, and the lower side-surface panel 6*b* serving as the side surfaces of the housing 2, or by the distance between the outer surfaces of the side surfaces facing to each other, but are not defined by each distance between the supports 7 at the corners of the housing 2.

As illustrated in FIG. 15*a*, the horizontal width La and the vertical width Lb have different lengths in the section at the upper part of the housing 2. The horizontal width La is the housing width of the upper part of the housing 2 in the long-side direction, and the vertical width Lb is the housing width of the upper part of the housing 2 in the short-side direction.

The horizontal width La in the section at the upper part of the housing 2 is defined by the distance between the outer surfaces of the upper heat exchanger 5*a*1 and the upper side-surface panel 6*a* facing to the upper heat exchanger 5*a*1. The vertical width Lb is defined by the distance between the outer surfaces of the upper heat exchangers 5*a*1 and 5*a*2.

As illustrated in FIG. 15*b*, the horizontal width la and the vertical width lb have different lengths in the section at the lower part of the housing 2. The horizontal width la is the housing width of the lower part of the housing 2 in the long-side direction, and the vertical width lb is the housing width of the lower part of the housing 2 in the short-side direction.

The horizontal width la in the section at the lower part of the housing 2 is defined by the length of the outer surface of the lower side-surface panel 6*b* in the long-side direction. The vertical width lb is defined by the distance between the outer surfaces of the lower heat exchanger 5*b* and the lower side-surface panel 6*b* facing to the lower heat exchanger 5*b* in the short-side direction.

In the outdoor unit 1 of the air-conditioning apparatus according to the present Embodiment 5, the horizontal widths La and la are longer than the vertical widths Lb and lb, and the vertical width Lb is longer than the vertical width lb. The horizontal width La is equal to the horizontal width la.

As illustrated in FIG. 16, the upper heat exchanger 5*a*1 includes a first straight part 20 disposed in the long-side direction of the housing 2, a second straight part 21 disposed in the short-side direction of the housing 2, and corners 22 each between the first straight part 20 and the second straight part 21. Angles 23 between the first straight part 20 and the second straight part 21 are each an obtuse angle. The upper heat exchanger 5*a*2 has the same configuration as that of the upper heat exchanger 5*a*1.

As illustrated in FIG. 17, shift of the upper heat exchanger 5*a* from the loser heat exchanger 5*b* changes in the long-side direction and the short-side direction. Specifically, the upper heat exchanger 5*a* tilts relative to the lower part of the housing 2 in the long-side direction and the short-side direction, the first straight part 20 tilts relative to the long-side direction of the lower part of the housing 2, and the second straight part 21 tilts relative to the short-side direction of the lower part of the housing 2.

FIG. 18 illustrates the distance between the axis line A of the fan 12 and the outer surface of the upper heat exchanger 5*a*. The distance XR between the axis line A of the fan 12 and an outer surface of the corner 22 of the upper heat exchanger 5*a* is short as compared to Embodiments 1 to 4. With this configuration, the distance between the fan 12 and the upper heat exchanger 5*a* is more uniform in the rotational direction of the fan 12, thereby achieving a more uniform wind speed through the upper heat exchanger 5*a* and thus more uniform suction wind speed distribution in the rotational direction of the fan 12. Consequently, the outdoor unit 1 of the air-conditioning apparatus, which can achieve noise reduction of the fan 12 and improved heat exchange efficiency, is achieved.

Embodiment 6

The following describes Embodiment 6 of the present invention. Any duplicate description of Embodiments 1 to 5 will be (partially) omitted, and any part identical to or equivalent to those in Embodiments 1 to 5 is denoted by an identical reference sign.

Figure 19:
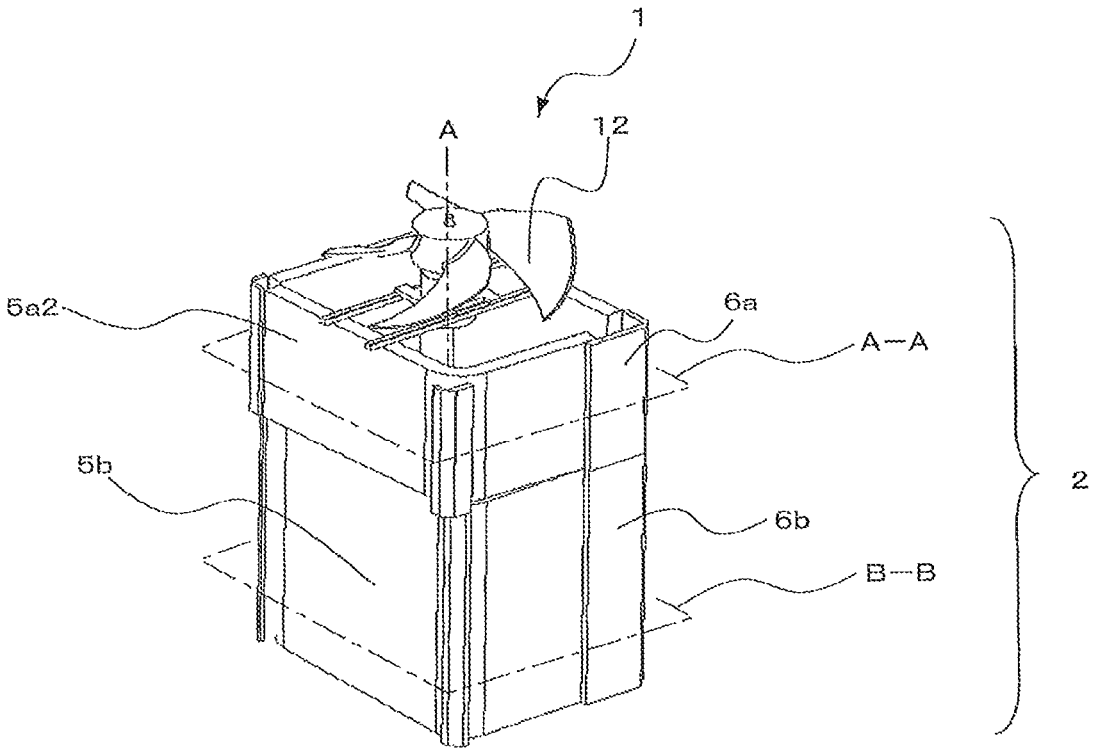
FIG. 19 is a diagram for description of cross sections of the outdoor unit of the air-conditioning apparatus according to Embodiment 6 of the present invention.
Figure 19A:
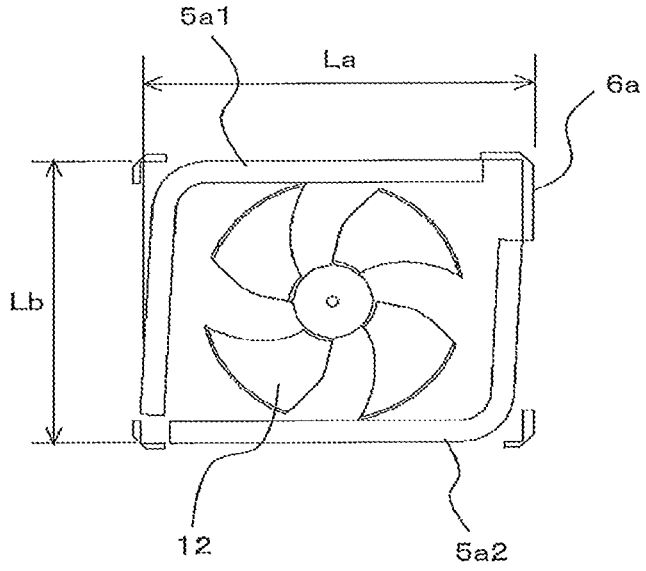
FIG. 19*a* is a schematic diagram of section A-A in FIG. 19.
Figure 19B:
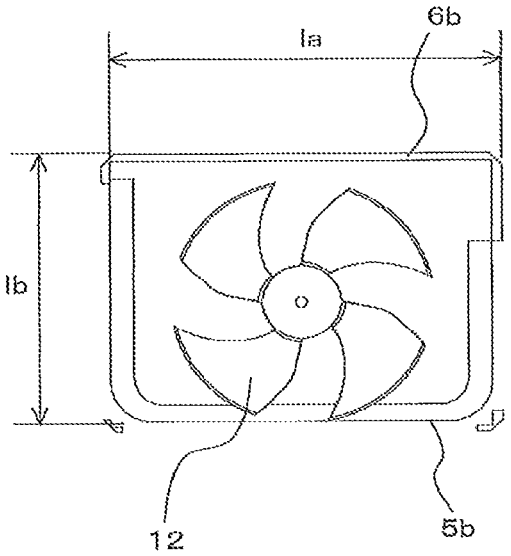
FIG. 19*b* is a schematic diagram of section B-B in FIG. 19.
Figure 20:
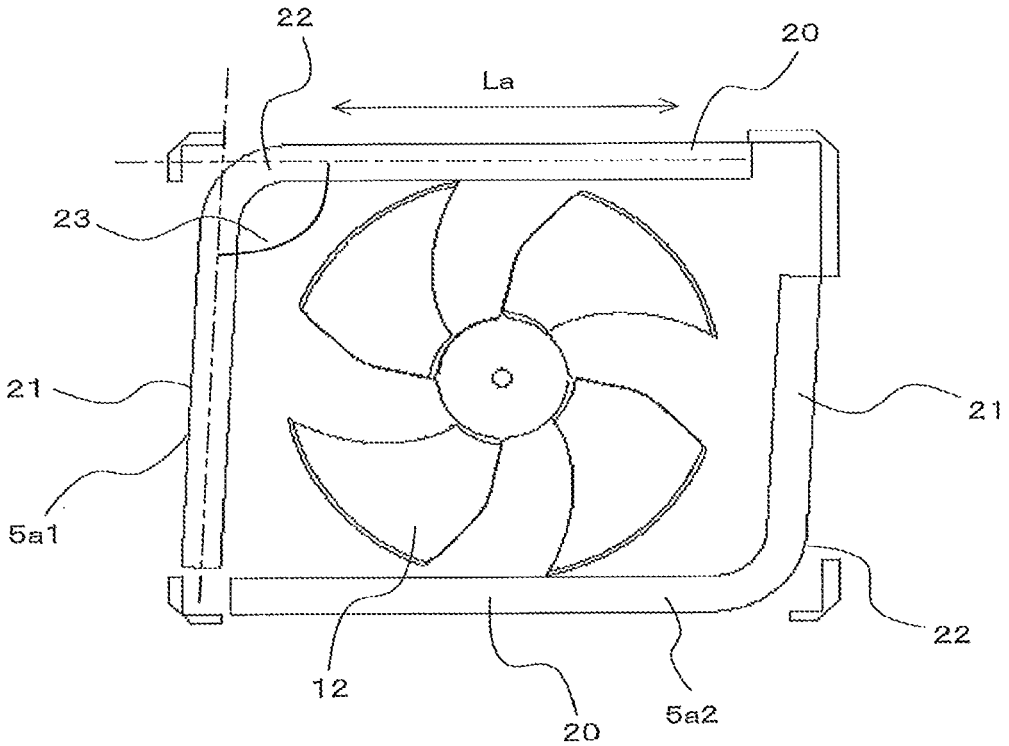
FIG. 20 is an enlarged view of FIG. 19*a*.
Figure 21:
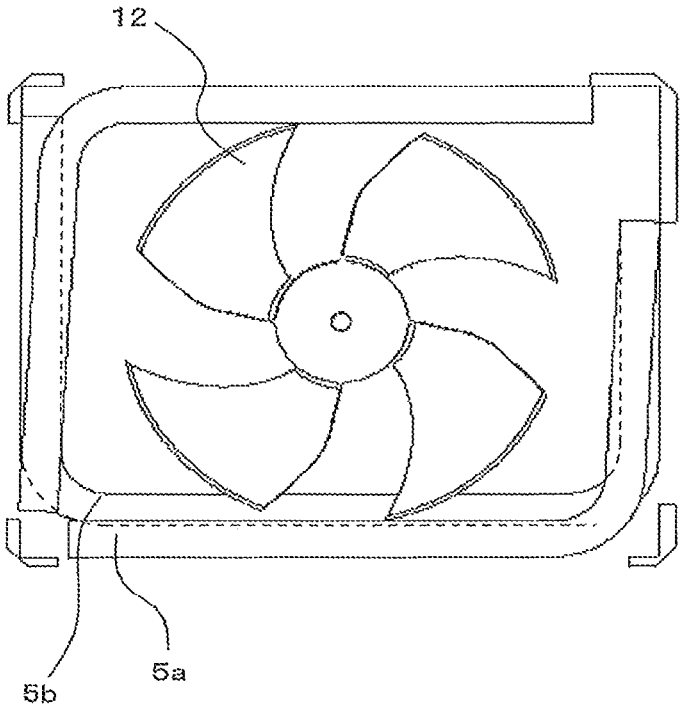
FIG. 21 is a diagram illustrating a state in which the section schematic diagram in FIG. 19*a* and the section schematic diagram in FIG. 19*b* are placed over each other.
Figure 22:
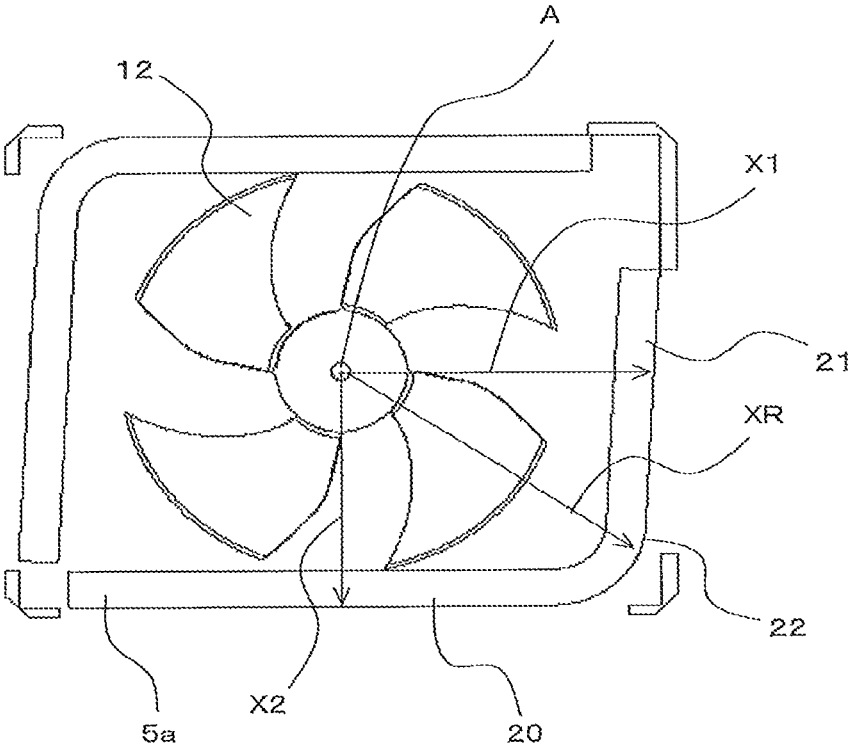
FIG. 22 is an explanatory diagram of FIG. 19*a*.

FIG. 19 is a diagram for description of cross sections of the outdoor unit 1 of the air-conditioning apparatus according to Embodiment 6 of the present invention. FIG. 19*a* is a schematic diagram of section A-A in FIG. 19. FIG. 19*b* is a schematic diagram of section B-B in FIG. 19. FIG. 20 is an enlarged view of FIG. 19*a*. FIG. 21 is a diagram of a state in which the section schematic diagram in FIG. 19*a* and the section schematic diagram in FIG. 19*b* are placed over each other. FIG. 22 is an explanatory diagram of FIG. 19*a*, FIGS. 19*a* and 19*b* are each a schematic diagram of a cross section of the housing 2 taken along the direction orthogonal to the direction of the axis line A of the fan 12. FIG. 19*a* is a section schematic diagram of the upper part of the housing 2. FIG. 19*b* is a section schematic diagram of the lower part of the housing 2. FIGS. 19 to 22 each illustrate the fan 12 to indicate the positional relation between the fan 12 and the heat exchanger 5.

In the outdoor unit 1 of the air-conditioning apparatus according to the present Embodiment 6, the upper heat exchangers 5*a*1 and 5*a*2 serving as the upper part of the housing 2 have shapes different from those in Embodiment 5 as illustrated in FIGS. 19 to 22, whereas any other configuration is the same.

In the present Embodiment 6, as illustrated in FIG. 19*a*, the upper heat exchanger 5*a*, the upper side-surface panel 6*a* substantially L-shaped in plan view, and the supports 7 each substantially L-shaped in plan view serve as the side surfaces of the upper part of the housing 2. The upper heat exchanger 5*a* includes the two upper heat exchangers 5*a*1 and 5*a*2 each substantially L-shaped in plan view and disposed to serve as the four side surfaces of the upper part of the housing 2.

As illustrated in FIG. 19*b*, the lower heat exchanger 5*b* and the lower side-surface panel 6*b* substantially L-shaped in plan view serve as the side surfaces of the lower part of the housing 2. The lower heat exchanger 5*b* is substantially inverse-J-shaped in plan view and disposed to serve as one side surface in the long-side direction and both side surfaces in the short-side direction among the four side surfaces of the lower part of the housing 2.

Housing widths at the upper and lower parts of the housing 2 of the outdoor unit 1 according to the present Embodiment 6 are related to the internal air path of the outdoor unit 1 as described later, and thus are defined by any component serving as the air path. Specifically, the housing widths are defined by the lengths of outer surfaces of the upper heat exchanger 5*a*, the lower heat exchanger 5*b*, the upper side-surface panel 6*a*, and the lower side-surface panel 6*b* serving as the side surfaces of the housing 2, or by the distance between the outer surfaces of the side surfaces facing to each other, but are not defined by each distance between the supports 7 at the corners of the housing 2.

As illustrated in FIG. 19*a*, the horizontal width La and the vertical width Lb have different lengths in the section at the upper part of the housing 2. The horizontal width La is the housing width of the upper part of the housing 2 in the long-side direction, and the vertical width Lb is the housing width of the upper part of the housing 2 in the short-side direction.

The horizontal width La in the section at the upper part of the housing 2 is defined by the distance between the outer surfaces of the upper heat exchanger 5*a*1 and the upper side-surface panel 6*a* facing to the upper heat exchanger 5*a*1. The vertical width Lb is defined by the distance between the outer surfaces of the upper heat exchangers 5*a*1 and 5*a*2.

As illustrated in FIG. 19*b*, the horizontal width la and the vertical width lb have different lengths in the section at the lower part of the housing 2. The horizontal width la is the housing width of the lower part of the housing 2 in the long-side direction, and the vertical width lb is the housing width of the lower part of the housing 2 in the short-side direction.

The horizontal width la in the section at the lower part of the housing 2 is defined by the length of the outer surface of the lower side-surface panel 6*b* in the long-side direction. The vertical width lb is defined by the distance between the outer surfaces of the lower heat exchanger 5*b* and the lower side-surface panel 6*b* facing to the lower heat exchanger 5*b* in the short-side direction.

In the outdoor unit 1 of the air-conditioning apparatus according to the present Embodiment 6 the horizontal widths La and la are longer than the vertical widths Lb and lb, and the vertical width Lb is longer than the vertical width lb. The horizontal width La is equal to the horizontal width la.

As illustrated in FIG. 20, the upper heat exchanger 5*a*1 includes the first straight part 20 disposed in the long-side direction of the housing 2, the second straight part 21 disposed in the short-side direction of the housing 2, and the corners 22 each between the first straight part 20 and the second straight part 21. The angles 23 between the first straight part 20 and the second straight part 21 are each an obtuse angle. The upper heat exchanger 5*a*2 has the same configuration as that of the upper heat exchanger 5*a*1.

As illustrated in FIG. 21, shift of the upper heat exchanger 5*a* from the lower heat exchanger 5*b* changes only in the long-side direction. Specifically, the upper heat exchanger 5*a* tilts relative to the lower part of the housing 2 only in the long-side direction, and the first straight part 20 is parallel to the long-side direction of the lower part of the housing 2.

FIG. 22 illustrates the distance between the axis line A of the fan 12 and the outer surface of the upper heat exchanger 5*a*. The distance XR between the axis line A of the fan 12 and the outer surface of the corner 22 of the upper heat exchanger 5*a* is short as compared to Embodiments 1 to 4. With this configuration, the distance between the fan 12 and the upper heat exchanger 5*a* is more uniform in the rotational direction of the fan 12, thereby achieving a more uniform wind speed through the upper heat exchanger 5*a* and thus more uniform suction wind speed distribution in the rotational direction of the fan 12. Consequently, the outdoor unit 1 of the air-conditioning apparatus, which can achieve noise reduction of the fan 12 and improved heat exchange efficiency is achieved.

As the distance X2 between the axis line A of the fan 12 and each of the outer surfaces of the upper heat exchangers 5*a*1 and 5*a*2 is short as illustrated in FIG. 18, the wind speed through the upper heat exchanger 5*a* in the short-side direction increases when the upper heat exchangers 5*a* facing to each other tilt in the short-side direction as in Embodiment 5. This configuration prevents the wind speeds through the upper heat exchangers 5*a* from being more uniform.

To solve this problem, in the present Embodiment 6, the upper heat exchangers 5*a* tilt not in the short-side direction but only in the long-side direction as illustrated in FIG. 22 so that the distance X2 between the axis line A of the fan 12 and the outer surface of each upper heat exchanger 5*a* is sufficient enough to prevent increase in the wind speeds through the upper heat exchangers 5*a* in the short-side direction. Consequently, the wind speeds through the upper heat exchangers 5*a* can be more uniform, thereby achieving the outdoor unit 1 of the air-conditioning apparatus, which can achieve noise reduction of the fan 12 and improved heat exchange efficiency.

Embodiment 7

The following describes Embodiment 7 of the present invention. Any duplicate description of Embodiments 1 to 6 will be (partially) omitted, and any part identical to or equivalent to those in Embodiments 1 to 6 is denoted by an identical reference sign.

Figure 23:
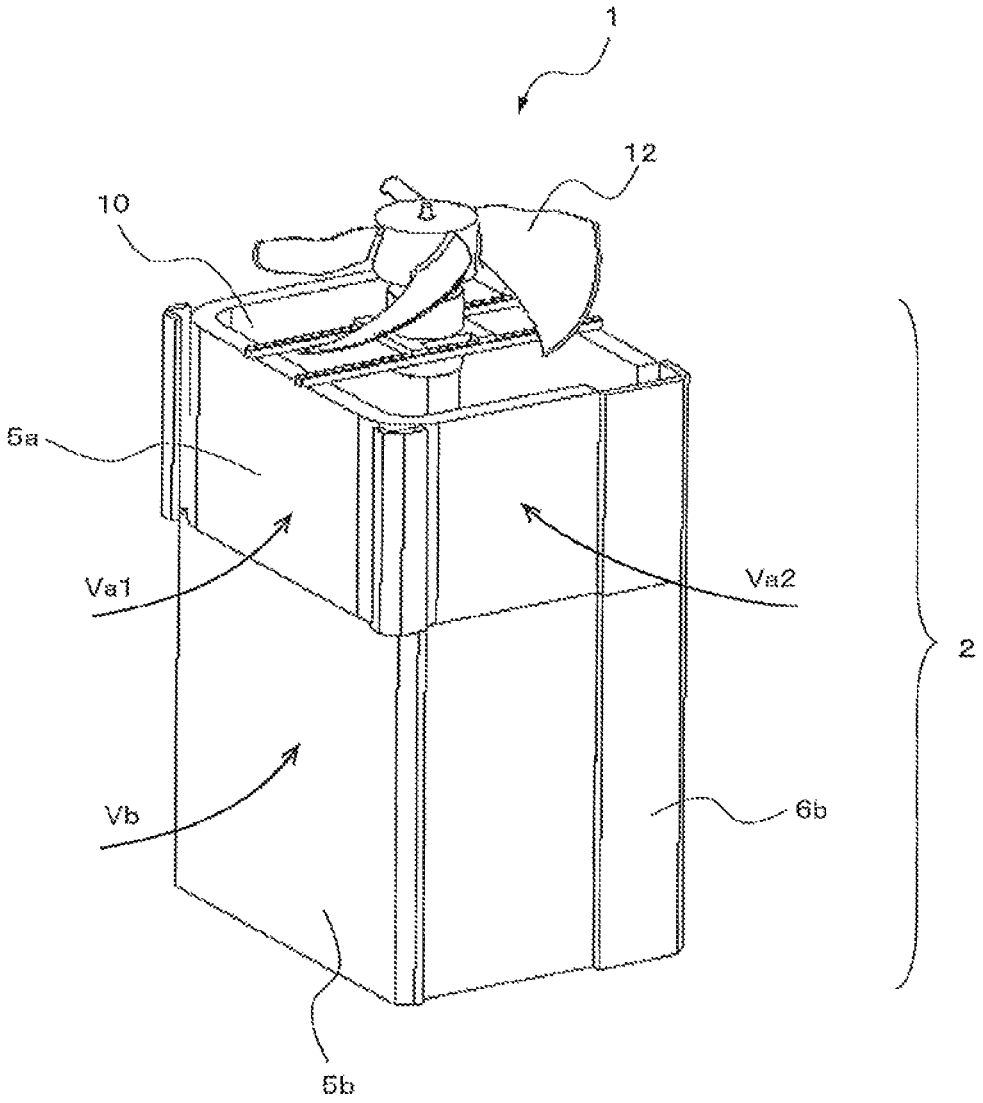
FIG. 23 is a perspective view of the outdoor unit of the air-conditioning apparatus according to Embodiment 7 of the present invention, from which the upper surface of the housing is removed.
Figure 24:
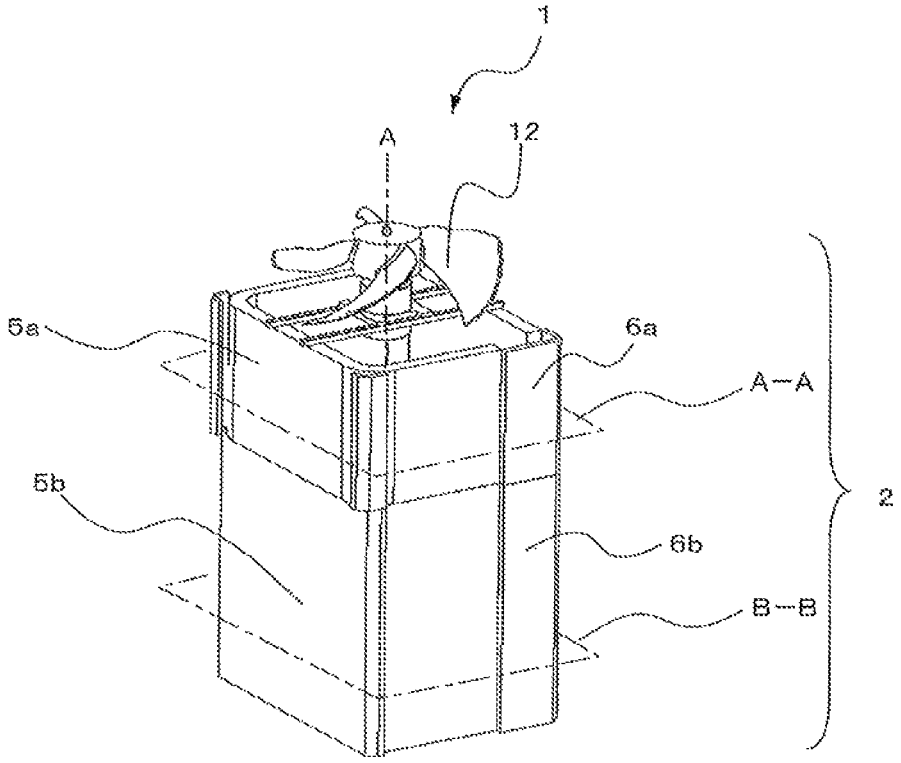
FIG. 24 is a diagram for description of cross sections of the outdoor unit of the air-conditioning apparatus according to Embodiment 7 of the present invention.
Figure 24A:
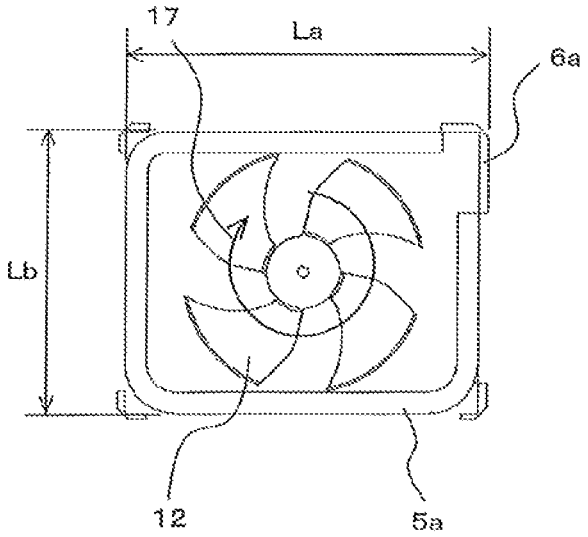
FIG. 24*a* is a schematic diagram of section A-A in FIG. 24.
Figure 24B:
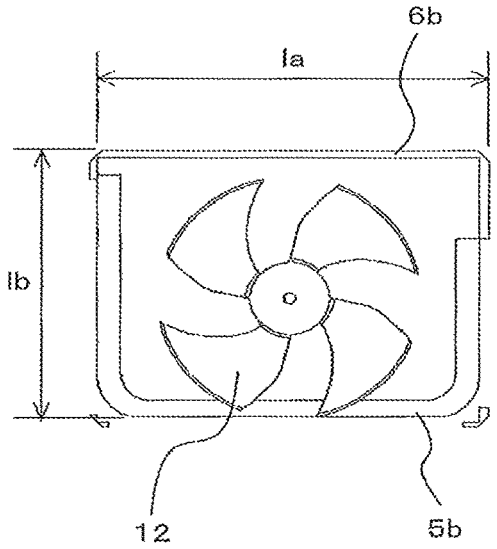
FIG. 24*b* is a schematic diagram of section B-B in FIG. 24.

FIG. 23 is a perspective view of the outdoor unit 1 of the air-conditioning apparatus according to Embodiment 7 of the present invention, from which the upper surface of the housing 2 is removed. FIG. 24 is a diagram for description of cross sections of the outdoor unit 1 of the air-conditioning apparatus according to Embodiment 7 of the present invention. FIG. 24*a* is a schematic diagram of section A-A in FIG. 24. FIG. 24*b* is a schematic diagram of section B-B in FIG. 24.

FIGS. 24*a* and 24*b* are each a schematic diagram of a cross section of the housing 2 taken along the direction orthogonal to the direction of the axis line A of the fan 12. FIG. 24*a* is a section schematic diagram of the upper part of the housing 2. FIG. 24*b* is a section schematic diagram of the lower part of the housing 2. FIGS. 24*a* and 24*b* each illustrate the fan 12 to indicate the positional relation between the fan 12 and the heat exchanger 5.

In the outdoor unit 1 of the air-conditioning apparatus according to the present Embodiment 7, the upper heat exchanger 5*a* serving as the upper part of the housing 2 is not divided in two but integrally formed as illustrated in FIGS. 23 and 24.

In the present Embodiment 7, as illustrated in FIG. 24*a*, the upper heat exchanger 5*a*, the upper side-surface panel 6*a* substantially L-shaped in plan view, and the supports 7 each substantially L-shaped in plan view serve as the side surfaces of the upper part of the housing 2. The upper heat exchanger 5*a* is substantially rectangular in plan view and disposed to serve as the four side surfaces of the upper part of the housing 2.

As illustrated in FIG. 24*b* the lower heat exchanger 5*b* and the lower side-surface panel 6*b* substantially L-shaped in plan view serve as the side surfaces of the lower part of the housing 2. The lower heat exchanger 5*b* is substantially inverse-J-shaped in plan view and disposed to serve as one side surface in the long-side direction and both side surfaces in the short-side direction among the four side surfaces of the lower part of the housing 2.

Housing widths at the upper and lower parts of the housing 2 of the outdoor unit 1 according to the present Embodiment 7 are related to the internal air path of the outdoor unit 1 as described later, and thus are defined by any component serving as the air path. Specifically, the housing widths are defined by the lengths of outer surfaces of the upper heat exchanger 5*a*, the lower heat exchanger 5*b*, the upper side-surface panel 6*a*, and the lower side-surface panel 6*b* serving as the side surfaces of the housing 2, or by the distance between the outer surfaces of the side surfaces facing to each other, but are not defined by each distance between the supports 7 at the corners of the housing 2.

As illustrated in FIG. 24*a*, the horizontal width La and the vertical width Lb have different lengths in the section at the upper part of the housing 2. The horizontal width La is the housing width of the upper part of the housing 2 in the long-side direction, and the vertical width Lb is the housing width of the upper part of the housing 2 in the short-side direction.

The horizontal width La in the section at the upper part of the housing 2 is defined by the distance between the outer surfaces of the upper heat exchanger 5*a* and the side-surface panel 6 facing to the upper heat exchanger 5*a*. The vertical width Lb is defined by the length of the outer surface of the upper heat exchanger 5*a* in the short-side direction.

As illustrated in FIG. 24*b*, the horizontal width la and the vertical width lb have different lengths in the section at the lower part of the housing 2. The horizontal width la is the housing width of the lower part of the housing 2 in the long-side direction, and the vertical width lb is the housing width of the lower part of the housing 2 in the short-side direction.

The horizontal width la in the section at the lower part of the housing 2 is defined by, the length of the outer surface of the lower side-surface panel 6*b* in the long-side direction. The vertical width lb is defined by the distance between the outer surfaces of the lower heat exchanger 5*b* and the lower side-surface panel 6*b* facing to the lower heat exchanger 5*b* in the short-side direction.

In the outdoor unit 1 of the air-conditioning apparatus according to the present Embodiment 7, the horizontal widths La and la are longer than the vertical widths Lb and lb, and the vertical width Lb is longer than the vertical width lb. The horizontal width La is equal to the horizontal width la.

Although the upper heat exchanger 5*a* according to Embodiments 1 to 6 is divided into two in the rotational direction of the fan 12, the upper heat exchanger 5*a* according to the present Embodiment 7 is integrally formed in the rotational direction 17 of the fan 12 as illustrated in FIG. 24*a*. When the heat exchanger 5 is divided, the wind speed distribution is not uniform in the rotational direction of the fan 12 between a region surrounded by the heat exchanger 5 and a region not surrounded by the heat exchanger 5. Thus, the integral formation can provide more uniform wind speed through the upper heat exchanger 5*a*. Consequently, the suction wind speed distribution can be more uniform in the rotational direction of the fan 12, thereby achieving the outdoor unit 1 of the air-conditioning apparatus, which can achieve noise reduction of the fan 12 and improved heat exchange efficiency.

Embodiment 8

The following describes Embodiment 8 of the present invention. Any duplicate description of Embodiments 1 to 7 will be (partially) omitted, and any part identical to or equivalent to those in Embodiments 1 to 7 is denoted by an identical reference sign.

Figure 25:
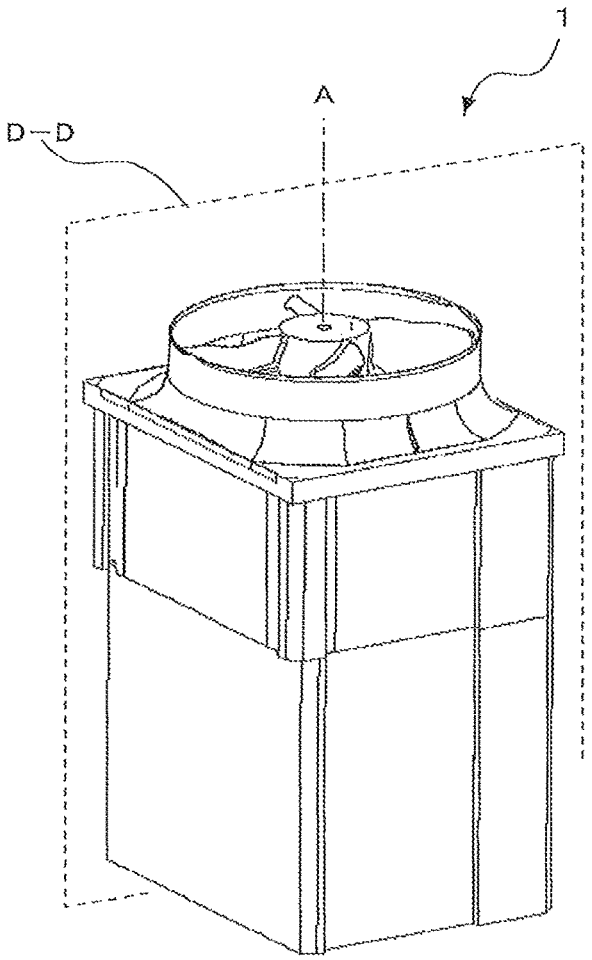
FIG. 25 is a diagram for description of a longitudinal section of the outdoor unit of the air-conditioning apparatus according to Embodiment 8 of the present invention.
Figure 25A:
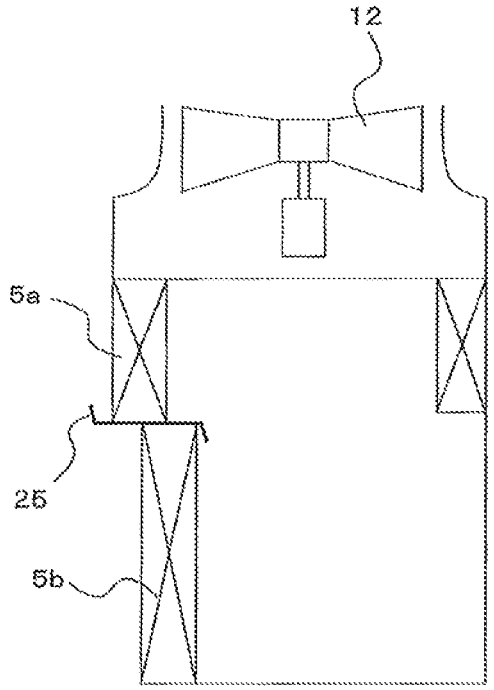
FIG. 25*a* is a schematic diagram of section D-D in FIG. 25.

FIG. 25 is a diagram for description of a longitudinal section of the outdoor unit 1 of the air-conditioning apparatus according to Embodiment 8 of the present invention. FIG. 25*a* is a schematic diagram of section D-D in FIG. 25.

FIG. 25*a* is a schematic diagram of a longitudinal section of the housing 2 taken along the direction of the axis line A of the fan 12, and is a schematic diagram of a section of the housing 2 in the short-side direction including the axis line A of the fan 12.

In the outdoor unit 1 of the air-conditioning apparatus according to the present Embodiment 8, as illustrated in FIG. 25*a*, an intermediate plate 25 is provided between the upper heat exchanger 5*a* and the lower heat exchanger 5*b* disposed at positions shifted from each other in the short-side direction on one side surface of the outdoor unit 1 in the short-side direction.

As illustrated in FIG. 25*a*, the outer surfaces of the upper heat exchanger 5*a* and the lower heat exchanger 5*b* are disposed at positions shifted from each other in the short-side direction on one side surface of the outdoor unit 1 in the short-side direction, and the lower heat exchanger 5*b* is shifted further on the inner side of the housing 2 than the upper heat exchanger 5*a* is. The intermediate plate 25 preventing airflow from the outside to the inside of the outdoor unit 1 is provided between the upper heat exchanger 5*a* and the lower heat exchanger 5*b*.

The intermediate plate 25 corresponds to a "second wind shielding plate" according to the present invention.

When the upper heat exchanger 5*a* and the lower heat exchanger 5*b* are disposed at positions shifted from each other as in the present Embodiment 8, a gap is provided at a coupled part (joint) between the upper heat exchanger 5*a* and the lower heat exchanger 5*b*, and some airflow passes through the gap instead of passing through the heat exchanger 5.

To avoid this problem, the intermediate plate 25 is provided between the upper heat exchanger 5*a* and the lower heat exchanger 5*b*, which are vertically divided from each other, thereby preventing leakage through, the gap to maintain a heat exchange capacity of the outdoor unit 1.

Embodiment 9

The following describes Embodiment 9 of the present invention. Any duplicate description of Embodiments 1 to 8 will be (partially) omitted, and any part identical to or equivalent to those in Embodiments 1 to 8 is denoted by an identical reference sign.

Figure 26:
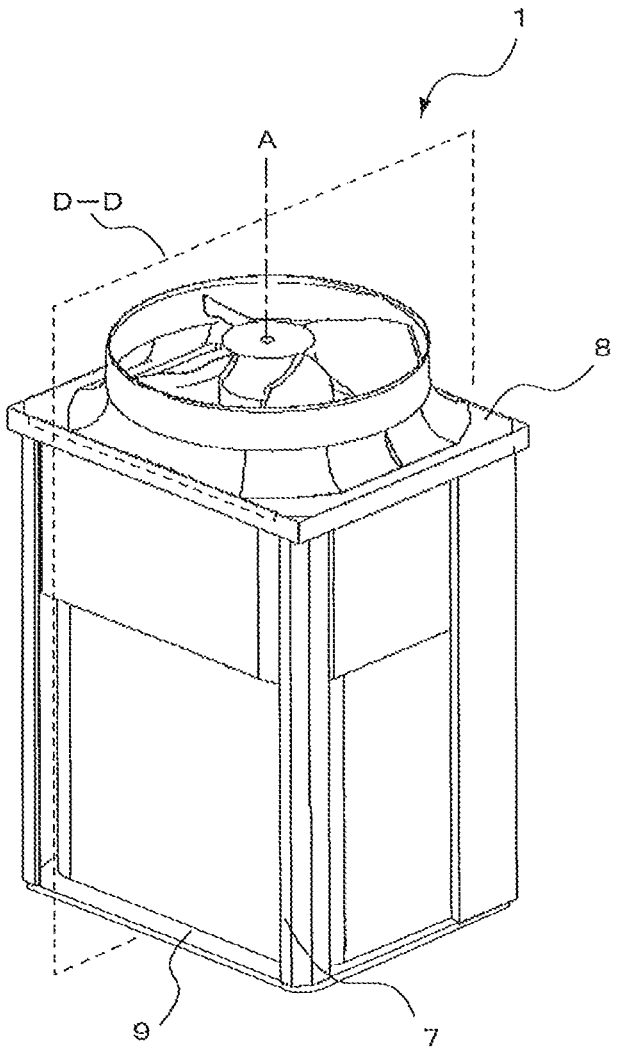
FIG. 26 is a diagram for description of a longitudinal section of the outdoor unit of the air-conditioning apparatus according to Embodiment 9 of the present invention.
Figure 26A:
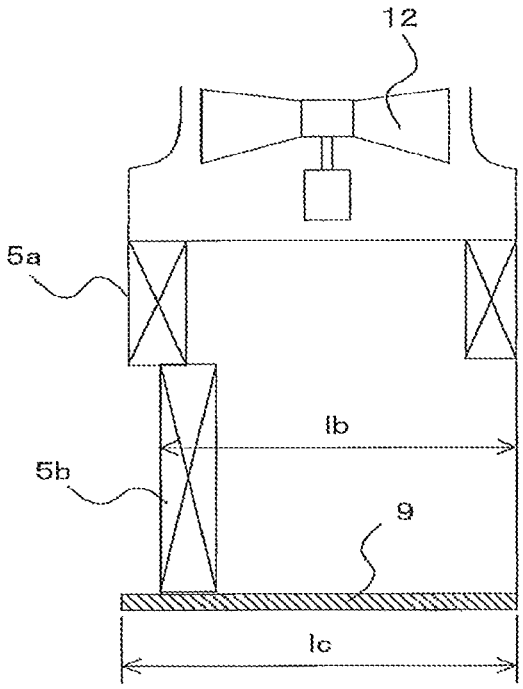
FIG. 26*a* is a schematic diagram of section D-D in FIG. 26.
Figure 27A:
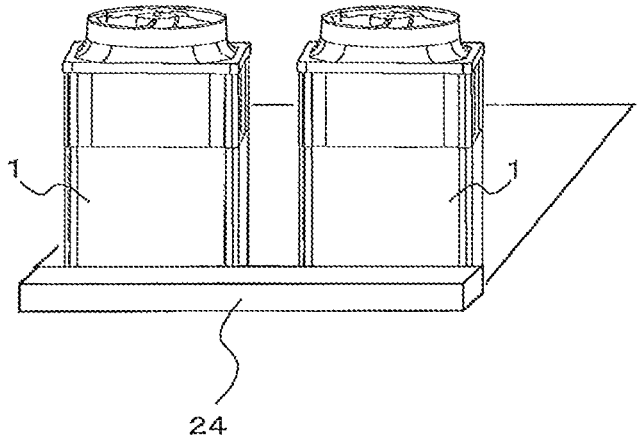
FIG. 27*a* is a perspective view illustrating exemplary installation of the outdoor units of the air-conditioning apparatus according to Embodiment 9 of the present invention.
Figure 27B:
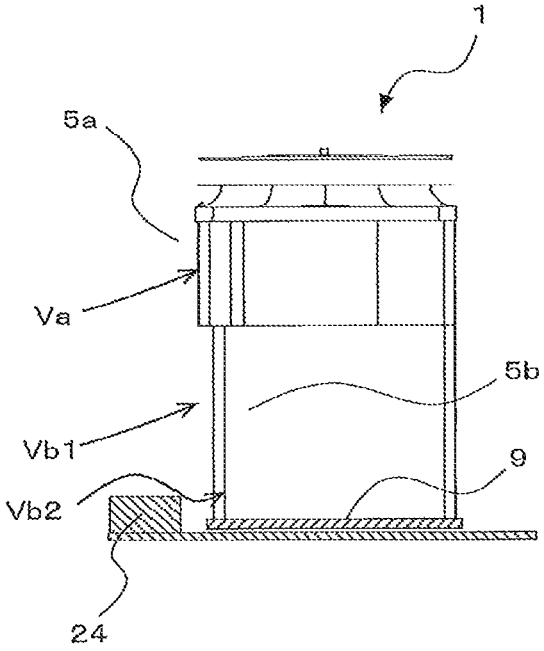
FIG. 27*b* is a front view illustrating the exemplary installation of the outdoor unit of the air-conditioning apparatus according to Embodiment 9 of the present invention.

FIG. 26 is a diagram for description of a longitudinal section of the outdoor unit 1 of the air-conditioning apparatus according to Embodiment 9 of the present invention. FIG. 26*a* is a schematic diagram of section D-D in FIG. 26. FIG. 27*a* is a perspective view illustrating exemplary installation of the outdoor units 1 of the air-conditioning apparatus according to Embodiment 9 of the present invention. FIG. 27*b* is a front view illustrating the exemplary installation of the outdoor unit 1 of the air-conditioning apparatus according to Embodiment 9 of the present invention.

FIG. 26*a* is a schematic diagram of a longitudinal section of the housing 2 taken along the direction of the axis line A of the fan 12, and is a schematic diagram of a section of the housing 2 in the short-side direction including the axis line A of the fan 12.

In the outdoor unit 1 of the air-conditioning apparatus according to the present Embodiment 9, each support 7 at the corner of the housing 2 is continuous from the top plate 8 to the bottom plate 9 in the height direction (vertical direction) as illustrated in FIG. 26, and a width lc of the bottom plate 9 in the short-side direction is longer than the vertical width lb of the lower part of the housing 2 as illustrated in FIG. 26*a*.

When the outdoor units 1 are installed close to the joist 24 on the roof of a building or other structures as illustrated in FIG. 27*a*, the joist 24 potentially prevents airflow into each lower heat exchanger 5*b*, which leads to degradation of heat exchange performance.

However, when the width lc of the bottom plate 9 in the short-side direction is longer than the vertical width lb of the lower part of the housing 2, a gap is provided between the joist 24 and the lower heat exchanger 5*b* at installation of the outdoor unit 1 as illustrated in FIG. 27*b* to allow flow of the wind Vb2 passing through a part of the lower heat exchanger 5*b* placed lower than the height of the joist 24, thereby improving the heat exchange performance. The above-described configuration allows simplification of the structure of the housing 2 through integrated formation of the support 7 each in the height direction. This integration facilitates reduction of manufacturing cost and assembly.

REFERENCE SIGNS LIST

1 outdoor unit 2 housing 3 built-in device 4*a* air inlet 4*b* air inlet 5 heat exchanger 5*a* upper heat exchanger 5*a*1 upper heat exchanger 5*a*2 upper heat exchanger 5*b* lower heat exchanger 6 side-surface panel 6*a* upper side-surface panel 6*b* lower side-surface panel 7 support 8 top plate 9 bottom plate 10 air outlet 11 bell mouth 12 fan 13 fan motor 14 motor support 15 boss 16 vane 17 rotational direction (of the fan) 18 guard 20 first straight part 21 second straight part 22 corner (of the upper heat exchanger) 23 angle 24 joist 25 intermediate plate 30 air-sending device 50 housing 51 upper heat exchanger 52 fan

The invention claimed is:

1. An outdoor unit of an air-conditioning apparatus, the outdoor unit comprising:

a housing having a box shape and including an air inlet formed on a side surface and an air outlet formed on an upper surface;

a fan provided to are upper side in the housing and configured to discharge, through the air outlet, outside air sucked through the air inlet; and a heat exchanger provided in the housing along the air inlet, the heat exchanger including an upper heat exchanger disposed at an upper part of the housing and a lower heat exchanger disposed at a lower part of the housing, and in plan view, the housing having four sides including two short-sides parallel to each other and two long sides parallel to each other in each of the upper and lower parts of the housing, the short sides and the long sides being alternately arranged to form the housing, a length of the short sides is different from a length of the long sides in the upper part of the housing, and a length of the short sides is different from a length of the long sides in the lower part of the housing, the length of each of the short-sides at the upper part of the housing are longer than the length of each of the short-sides at the lower part of the housing, the length of each of the short sides in the lower part have a same length, and the length of each of the long sides in the upper part have a same length.

2. The outdoor unit of the air-conditioning apparatus of claim 1, wherein, in plan view, the width in the long-side direction at the upper part of the housing is the same as the width in the long-side direction at the lower part of the housing.

3. The outdoor unit of the air-conditioning apparatus of claim 1, wherein the lower heat exchanger is disposed along one side surface of the housing in the short-side direction in plan view.

4. The outdoor unit of the air-conditioning apparatus of claim 3, wherein the upper heat exchanger and the lower heat exchanger are disposed along the one side surface, and an outer surface of the lower heat exchanger is disposed closer to an inner side of the housing than is an outer surface of the upper heat exchanger.

5. The outdoor unit of the air-conditioning apparatus of claim 4, further comprising:

a wind shielding plate provided below the upper heat exchanger to prevent wind from passing, wherein the upper heat exchanger and the wind shielding plate are disposed in a side surface facing to the one side surface, and an outer surface of the wind shielding plate is disposed closer to an inner side of the housing than is the outer surface of the upper heat exchanger.

6. The outdoor unit of the air-conditioning apparatus of claim 4, wherein a second wind shielding plate for preventing wind passing is provided between the upper heat exchanger and the lower heat exchanger.

7. The outdoor unit of the air-conditioning apparatus of claim 1, wherein the upper heat exchanger includes a first upper heat exchanger and a second upper heat exchanger, the first upper heat exchanger and the second upper heat exchanger each include a first straight part disposed in the long-side direction of the housing, a second straight part disposed in the short-side direction of the housing, and a corner between the first straight part and the second straight part, and an angle between the first straight part and the second straight part is an obtuse angle.

8. The outdoor unit of the air-conditioning apparatus of claim 7, wherein the first straight part of the upper heat exchanger is parallel to the long-side direction of the lower part of the housing.

9. The outdoor unit of the air-conditioning apparatus of claim 1, wherein the upper heat exchanger is integrally formed and disposed in four side surfaces of the upper part of the housing.

10. The outdoor unit of the air-conditioning apparatus of claim 1, wherein the lower heat exchanger is disposed in three side surfaces of the housing.

11. An outdoor unit of an air-conditioning apparatus, the outdoor unit comprising:

a housing having a box shape and including an air inlet formed on a side surface and an air outlet formed on an upper surface;

a fan provided to an upper side in the housing and configured to discharge, through the air outlet, outside air sucked through the air inlet;

a heat exchanger provided in the housing along the air inlet, the heat exchanger including an upper heat exchanger disposed at an upper part of the housing and a lower heat exchanger disposed at a lower part of the housing, and a wind shielding plate provided below the upper heat exchanger to prevent wind from passing, and in plan view, the housing having four sides including two short-sides facing each other and two long sides facing each other in each of the upper and lower parts of the housing, the short sides and the long sides being alternately arranged to form the housing, a length of the short sides is different from a length of the long sides in the upper part of the housing, and a length of the short sides is different from a length of the long sides in the lower part of the housing, the length of each of the short-sides at the upper part of the housing are longer than the length of each of the short-sides at the lower part of the housing, the length of each of the long-sides at the upper part of the housing are the same as the length of each of the long-sides at the lower part of the housing, the upper heat exchanger is disposed along the four sides of the upper part of the housing, the lower heat exchanger is not disposed along at least one side of the four sides of the lower part of the housing, the at least one side of the four sides including one of the two long-sides, and the wind shielding plate is disposed in the at least one side of the lower part of the housing along which the lower heat exchanger is not disposed, and an outer surface of a part of the lower heat exchanger, the part being disposed along another of the two long-sides of the lower part of the housing is disposed closer to an inner side of the housing than is an outer surface of a part of the upper heat exchanger, the part being disposed along one of the two-long-sides of the upper part of the housing above the another of the two long-sides of the lower part of the housing.

12. An outdoor unit of an air-conditioning apparatus, the outdoor unit comprising:

a housing having a box shape and including an air inlet formed on a side surface and an air outlet formed on an upper surface;

a fan provided to an upper side in the housing and configured to discharge, through the air outlet, outside air sucked through the air inlet; and a heat exchanger provided in the housing along the air inlet, the heat exchanger including an upper heat exchanger disposed at an upper part of the housing and a lower heat exchanger disposed at a lower part of the housing, and in plan view, the housing having four sides including two short-sides facing each other and two long sides facing each other in each of the upper and lower parts of the housing, the short sides and the long sides being alternately arranged to form the housing, a length of the short sides is different from a length of the long sides in the upper part of the housing, and a length of the short sides is different from a length of the long sides in the lower part of the housing, the length of each of the short-sides at the upper part of the housing are longer than the length of each of the short-sides at the lower part of the housing, the length of each of the short sides in the lower part have a same length, the length of each of the long sides in the upper part have a same length, and the length of each of the long-sides at the upper part of the housing are the same as the length of each of the long-sides at the lower part of the housing.

* * * * *